US012220033B2

(12) United States Patent
Attal et al.

(10) Patent No.: US 12,220,033 B2
(45) Date of Patent: Feb. 11, 2025

(54) APPLICATION OF HAIR-COLORING COMPOSITIONS

(71) Applicant: APPLIMIND LTD., Zihron Yaakov (IL)

(72) Inventors: Yves Attal, Binyamina (IL); David Humash, Zihron Yaakov (IL)

(73) Assignee: APPLIMIND LTD., Zihron Yaakov (IL)

( * ) Notice: Subject to any disclaimer, the term of this patent is extended or adjusted under 35 U.S.C. 154(b) by 0 days.

(21) Appl. No.: 18/008,463

(22) PCT Filed: Jun. 7, 2021

(86) PCT No.: PCT/IB2021/054962
§ 371 (c)(1),
(2) Date: Dec. 6, 2022

(87) PCT Pub. No.: WO2021/250536
PCT Pub. Date: Dec. 16, 2021

(65) Prior Publication Data

US 2023/0189957 A1 Jun. 22, 2023

Related U.S. Application Data

(60) Provisional application No. 63/036,109, filed on Jun. 8, 2020.

(51) Int. Cl.
*A45D 19/02* (2006.01)
*A45D 19/00* (2006.01)
*A45D 19/18* (2006.01)

(52) U.S. Cl.
CPC ..... *A45D 19/0066* (2021.01); *A45D 19/012* (2021.01); *A45D 19/022* (2021.01); *A45D 19/18* (2013.01); *A45D 2019/0033* (2013.01)

(58) Field of Classification Search
CPC .. A45D 19/026; A45D 24/28; A45D 19/0066; A45D 19/022; A45D 19/18; A45D 2019/0033
See application file for complete search history.

(56) References Cited

U.S. PATENT DOCUMENTS 3,932,908 A * 1/1976 Bitgood ..... A47L 17/00 15/24
4,323,085 A 4/1982 Roehm
(Continued)

FOREIGN PATENT DOCUMENTS

CN 201260466 Y 7/2009
EP 1203593 B1 5/2002
(Continued)

*Primary Examiner* — Nicholas D Lucchesi
*Assistant Examiner* — Jennifer Gill
(74) *Attorney, Agent, or Firm* — Manelli Selter PLLC; Edward Stemberger

(57) ABSTRACT

An application device for applying hair-coloring composition, comprising a device body, comprising a first reservoir comprising a first piston; the first reservoir configured to receive a first part of a hair-coloring composition; a second reservoir comprising a second piston; the second reservoir configured to receive a second part of a hair-coloring composition; and a dispensing mechanism associated with the first piston and with the second piston: the dispensing mechanism configured to sealingly move the first piston inside the first reservoir and the second piston inside the second reservoir; and an application cap, comprising a mixing mechanism; and a plurality of projecting tines: wherein the application cap is configured for reversible-connection with the device body such that, when the application cap is connected with the device body, the first reservoir and the second reservoir are sealed from the outside except channels of the plurality of projecting tines which are in fluid communication with the first reservoir and
(Continued)

the second reservoir, through the mixing mechanism; and wherein the dispensing mechanism is configured, when activated, to move the first piston and the second piston towards the plurality of projecting tines thereby mixing the first part of the hair-coloring composition with the second part of the hair-coloring composition to form a mixed hair-coloring composition to be dispensed through the plurality of projecting tines.

3 Claims, 19 Drawing Sheets

(56) References Cited

U.S. PATENT DOCUMENTS 5,289,835 A * 3/1994 Harlan ..... A45D 19/026 401/175
6,357,450 B1 * 3/2002 Paice ..... A45D 19/026 222/137
6,513,534 B1 * 2/2003 Sofer ..... A45D 24/28 401/28
7,055,528 B2 6/2006 Shah et al.
7,568,486 B2 8/2009 Vrus
9,462,873 B2 * 10/2016 Casasanta, III ..... A45D 40/262
2003/0131864 A1 * 7/2003 Lu ..... A45D 19/026 132/112
2003/0217438 A1 11/2003 Verbrugge et al.
2005/0092340 A1 5/2005 Rijskamp
2006/0054178 A1 3/2006 Sim
2007/0157942 A1 7/2007 Adkins
2007/0197968 A1 * 8/2007 Pongpairochana ..... A61M 5/34 604/67
2009/0264816 A1 * 10/2009 Johnson ..... B01F 27/13 604/82
2010/0132730 A1 * 6/2010 Jung ..... A46B 11/0065 401/269
2012/0192893 A1 8/2012 Anderson
2013/0003493 A1 * 1/2013 Payne ..... B01F 27/2311 366/286
2015/0053227 A1 2/2015 Sugunan et al.
2015/0182002 A1 * 7/2015 Hartstock-Martin ..... A61M 35/003 401/270
2016/0022010 A1 1/2016 Rabe et al.
2016/0143408 A1 * 5/2016 Grez ..... A46B 11/0055 132/221
2016/0193575 A1 * 7/2016 Dinnison ..... B01F 27/0541 366/343

FOREIGN PATENT DOCUMENTS

KR 101762262 B1 7/2017
KR 20180006008 A 1/2018
WO 2004073448 9/2004
WO 2004087036 10/2004

* cited by examiner

APPLICATION OF HAIR-COLORING COMPOSITIONS

CROSS-REFERENCE TO RELATED PATENT APPLICATIONS

This patent application claims priority from and is related to U.S. Provisional Patent Application Ser. No. 63/036,109, filed 8 Jun. 2020, this U.S. Provisional Patent Application incorporated by reference in its entirety herein.

FIELD OF THE INVENTION

The present invention generally relates to the field of hair-coloring and specifically to, but not exclusively, to devices, kits and methods useful for applying hair-coloring compositions to hair, especially human hair.

BACKGROUND OF THE INVENTION

There is often a need for applying hair-coloring compositions to hair, especially human hair. One particular need is to color gray hair that grows naturally, for example, in older people.

Devices and methods for applying hair-coloring compositions to the hair are known, see for example: U.S. Pat. Nos. 5,289,835; 6,513,534 and 7,055,528; US Patent Applications: 2003/0217438; 2005/0092340; 2006/0054178; 2007/0157942; 2012/0192893; 2015/0053227; 2016/0022010 and PCT patent publications: WO 2004/073448 and WO 2004/087036.

Current devices and methods for applying hair-coloring compositions have disadvantages.

It would be useful to have a device and/or a method for applying hair-coloring compositions to the hair that have one or more advantages compared to known devices and methods.

SUMMARY OF THE INVENTION

Some embodiments of the invention relate to devices, kits and methods useful for applying hair-coloring compositions to hair, especially human hair.

According to an aspect of some embodiments of the invention there are provided application devices, kits and methods suitable for applying hair-coloring composition to the roots of hair growing from the scalp of a human head, substantially as described herein.

According to an aspect of the present invention there is provided an application device for applying hair-coloring composition, comprising: a device body, comprising: a first reservoir comprising a first piston; the first reservoir configured to receive a first part of a hair-coloring composition; a second reservoir comprising a second piston; the second reservoir configured to receive a second part of a hair-coloring composition; and a dispensing mechanism associated with the first piston and with the second piston; the dispensing mechanism configured to sealingly move the first piston inside the first reservoir and the second piston inside the second reservoir; and an application cap, comprising: a mixing mechanism; and a plurality of projecting tines; wherein the application cap is configured for reversible-connection with the device body such that, when the application cap is connected with the device body, the first reservoir and the second reservoir are sealed from the outside except channels of the plurality of projecting tines which are in fluid communication with the first reservoir and the second reservoir, through the mixing mechanism; and wherein the dispensing mechanism is configured, when activated, to move the first piston and the second piston towards the plurality of projecting tines thereby mixing the first part of the hair-coloring composition with the second part of the hair-coloring composition to form a mixed hair-coloring composition to be dispensed through the plurality of projecting tines.

The dispensing mechanism may comprise a first cogwheel, having an inner thread and outer teeth, mounted beneath the first piston; a second cogwheel, having an inner thread and outer teeth, mounted beneath the second piston; a third cogwheel, having outer teeth, mounted between and in contact with the first cogwheel and the second cogwheel; and a motor; wherein the first piston is connected with a first threaded shaft and the second piston is connected with a second threaded shaft such that the outer thread of the first threaded shaft, mesh with the inner thread of the first cogwheel, and the outer thread of the second threaded shaft, mesh with the inner thread of the second cogwheel; wherein the outer teeth of the third cogwheel mesh with the outer teeth of the first and second cogwheels; and wherein the motor is configured to rotate the third cogwheel, thereby rotating the first and second cogwheels, thereby moving the first and second pistons.

The first reservoir may be in fluid communication with the mixing mechanism through a first orifice, and the second reservoir may be in fluid communication with the mixing mechanism through a second orifice; wherein the mixing mechanism may comprise a static mixer mounted in a channel; wherein the channel is configured to receive the first part of the hair-coloring composition and the second part of the hair-coloring composition on one end thereof, and provide a mixed hair-coloring composition on the other end thereof.

The dispensing mechanism may comprise: a first set of transmission wheels comprising a first transmission wheel and a second transmission wheel; a second set of transmission wheels comprising a third transmission wheel and a fourth transmission wheel; and at least one motor; wherein the first piston is connected with a first flexible lead cable and the second piston is connected with a second flexible lead cable such that the first flexible lead cable, pass between and in contact with the first transmission wheel and the second transmission wheel, and the second flexible lead cable pass between and in contact with the third transmission wheel and the fourth transmission wheel; and wherein the at least one motor is configured to rotate the first, second, third and fourth transmission wheels, thereby moving the first and second pistons.

The dispensing mechanism may comprise: a first cogwheel, having outer teeth, mounted beneath the first piston; a second cogwheel, having outer teeth, mounted beneath the second piston; a third cogwheel, having outer teeth, mounted between and in contact with the first cogwheel and the second cogwheel; and a motor; wherein the first cogwheel is connected with a first threaded shaft and the second cogwheel is connected with a second threaded shaft; wherein the first piston is mounted around the first threaded shaft and the second piston is mounted around the second threaded shaft such that an outer thread of the first threaded shaft, mesh with an inner thread of the first piston, and an outer thread of the second threaded shaft, mesh with an inner thread of the second piston; wherein the outer teeth of the third cogwheel mesh with the outer teeth of the first and second cogwheels; and wherein the motor is configured to rotate the third cogwheel, thereby rotating the first and second cogwheels, thereby moving the first and second pistons.

The first reservoir may be configured to receive the first part of a hair-coloring composition in a first capsule; and wherein the second reservoir may be configured to receive the second part of a hair-coloring composition in a second capsule.

According to another aspect of the present invention, there is provided a hair-coloring composition capsule, comprising: a first reservoir, comprising a first part of a hair-coloring composition; and a second reservoir, comprising a second part of a hair-coloring composition.

According to another aspect of the present invention, there is provided a hair-coloring composition capsule, comprising: a first reservoir, comprising: a first piston mounted at the lower end of the first reservoir; and a first part of a hair-coloring composition; a second reservoir, comprising: a second piston mounted at the lower end of the second reservoir; and a second part of a hair-coloring composition; the first and second pistons configured to be moved thereby pushing the first part of the hair-coloring composition out of the first reservoir and the second part of the hair-coloring composition out of the second reservoir.

The hair-coloring composition capsule may further comprise: a first opening beneath the first piston; and a second opening beneath the second piston; the first and second openings configured to enable contact with the first and second pistons. The hair-coloring composition capsule may further comprise a removable cover.

The first reservoir may further comprise: a first threaded shaft extending from the lower end to the upper end of the first reservoir; wherein the first piston is mounted around the first threaded shaft and comprises an inner thread, such that the outer thread of the first threaded shaft, mesh with the inner thread of the first piston;

and wherein the a second reservoir further comprises: a second threaded shaft extending from the lower end to the upper end of the second reservoir; wherein the second piston is mounted around the second threaded shaft and comprises an inner thread, such that the outer thread of the second threaded shaft, mesh with the inner thread of the second piston.

According to another aspect of the present invention, there is provided a hair-coloring composition capsule, comprising: a first reservoir, comprising: a first piston having an inner thread, mounted at the lower end of the first reservoir, around a first threaded shaft extending from the lower end to the upper end of the first reservoir, such that the outer thread of the first threaded shaft, mesh with the inner thread of the first piston; and a first part of a hair-coloring composition; a second reservoir, comprising: a second piston having an inner thread, mounted at the lower end of the second reservoir, around a second threaded shaft extending from the lower end to the upper end of the second reservoir, such that the outer thread of the second threaded shaft, mesh with the inner thread of the second piston; and a second part of a hair-coloring composition; the first and second pistons configured to be moved thereby pushing the first part of the hair-coloring composition out of the first reservoir and the second part of the hair-coloring composition out of the second reservoir.

According to another aspect of the present invention, there is provided an application device for applying hair-coloring composition, comprising: a device body, comprising: a first reservoir configured to receive a capsule of a hair-coloring composition; the capsule comprises: a second reservoir comprising a first part of a hair-coloring composition; and a third reservoir comprising a second part of a hair-coloring composition; and a dispensing mechanism configured dispense the first part of the hair-coloring composition and the second part of the hair-coloring composition out of the capsule; and an application cap, comprising: a mixing mechanism; and a plurality of projecting tines; wherein the application cap is configured for reversible-connection with the device body such that, when the application cap is connected with the device body, the first reservoir is sealed from the outside except channels of the plurality of projecting tines which are in fluid communication with the first reservoir, through the mixing mechanism; and wherein the dispensing mechanism is configured, when activated, to dispense the hair-coloring composition out of the capsule towards the plurality of projecting tines thereby mixing the first part of the hair-coloring composition with the second part of the hair-coloring composition to form a mixed hair-coloring composition to be dispensed through the plurality of projecting tines.

The dispensing mechanism may comprise: a first set of transmission wheels comprising a first transmission wheel and a second transmission wheel; a first flexible lead cable passing between and in contact with the first transmission wheel and the second transmission wheel; a first elevating part connected with the upper end of the first flexible lead cable; a second set of transmission wheels comprising a third transmission wheel and a fourth transmission wheel; a second flexible lead cable passing between and in contact with the third transmission wheel and the fourth transmission wheel; a second elevating part connected with the upper end of the second flexible lead cable; and at least one motor.

The second reservoir may further comprise a first piston mounted at the lower end of the second reservoir; wherein the third reservoir further comprises a second piston mounted at the lower end of the third reservoir; wherein the first elevating part is configured to be in contact with the first piston and the second elevating part is configured to be in contact with the second piston when the capsule is inserted into the first reservoir; and wherein the at least one motor is configured to rotate the first, second, third and fourth transmission wheels, thereby moving the first and second pistons.

The dispensing mechanism may comprise: a first recessed gear, having outer teeth, mounted beneath the second reservoir; a second recessed gear, having outer teeth, mounted beneath the third reservoir; a cogwheel, having outer teeth, mounted between and in contact with the first recessed gear and the second recessed gear, such that the outer teeth of the cogwheel mesh with the outer teeth of the first recessed gear and the outer teeth of the second recessed gear; and a motor.

The second reservoir may further comprise: a first threaded shaft extending from the lower end to the upper end of the second reservoir; a first gear, connected with the first threaded shaft, and protruding from the lower end of the second reservoir; and a first piston mounted around the first threaded shaft and comprises an inner thread, such that the outer thread of the first threaded shaft mesh with the inner thread of the first piston; wherein the a third reservoir further comprises: a second threaded shaft extending from the lower end to the upper end of the third reservoir; a second gear, connected with the second threaded shaft, and protruding from the lower end of the third reservoir; and a second piston mounted around the second threaded shaft and comprises an inner thread, such that the outer thread of the second threaded shaft mesh with the inner thread of the second piston; wherein the first gear is configured to be in contact with the first recessed gear and the second gear is configured to be in contact with the second recessed gear when the capsule is inserted into the first reservoir; and wherein the motor is configured to rotate the cogwheel, thereby rotating the first and second recessed gears, thereby moving the first and second pistons.

According to another aspect of the present invention, there is provided a disposable application cap, comprising: a plurality of projecting tines; and a mixing mechanism, comprising: a static mixer mounted in a channel; wherein the channel is configured to receive a first part of a hair-coloring composition and a second part of a hair-coloring composition on one end thereof, and provide a mixed hair-coloring composition on the other end thereof.

According to another aspect of the present invention, there is provided an application device for applying hair-coloring composition, comprising: a device body, comprising: a reservoir comprising a piston; the reservoir configured to receive a first part and a second part of a hair-coloring composition; and a dispensing mechanism associated with the piston; the dispensing mechanism configured to sealingly move the piston inside the reservoir; a mixing cap, comprising: an impeller, mounted on the inner side of the mixing cap; a rod connected with the impeller on one end thereof and on the other end thereof with a gear mounted on the outer side of the mixing cap; and an application cap comprising a plurality of projecting tines; wherein the mixing cap is configured for reversible-connection with the device body such that, when the mixing cap is connected with the device body, the reservoir is sealed from the outside and the impeller is configured to mix the first part and the second part of the hair-coloring composition to form a mixed hair-coloring composition; wherein the application cap is configured for reversible-connection with the device body such that, when the application cap is connected with the device body, the reservoir is sealed from the outside except channels of the plurality of projecting tines which are in fluid communication with the reservoir; and wherein the dispensing mechanism is configured, when activated, to move the piston towards the plurality of projecting tines thereby pushing the mixed hair-coloring composition to be dispensed through the plurality of projecting tines.

According to another aspect of the present invention, there is provided an application device for applying hair-coloring composition, comprising: a device body, comprising: a reservoir comprising a piston; the reservoir configured to receive a first part and a second part of a hair-coloring composition; a stirring mechanism; and a dispensing mechanism associated with the piston; the dispensing mechanism configured to sealingly move the piston inside the reservoir; and an application cap comprising a plurality of projecting tines; wherein the stirring mechanism is configured to mix the first part and the second part of the hair-coloring composition to form a mixed hair-coloring composition; wherein the application cap is configured for reversible-connection with the device body such that, when the application cap is connected with the device body, the reservoir is sealed from the outside except channels of the plurality of projecting tines which are in fluid communication with the reservoir; and wherein the dispensing mechanism is configured, when activated, to move the piston towards the plurality of projecting tines thereby pushing the mixed hair-coloring composition to be dispensed through the plurality of projecting tines. The stirring mechanism may comprise: an impeller; and a shaft connected with the impeller on one end thereof and on the other end thereof with a gear mounted on the outer lower side of the device body; wherein the gear is configured to be rotated thereby rotating the impeller and enabling mixing the first part and the second part of the hair-coloring composition to form a mixed hair-coloring composition.

The stirring mechanism may comprise: an impeller; and a shaft connected with the impeller on one end thereof and on the other end thereof with a motor; wherein the motor is configured to rotated the shaft thereby rotating the impeller and enabling mixing the first part and the second part of the hair-coloring composition to form a mixed hair-coloring composition.

The impeller may be a collapsible impeller having at least two states, each with a different height dimension: a stirring state having a uncollapsed height dimensions; and a collapsed state having a collapsed height dimension smaller than the uncollapsed height dimension.

The gear may be configure to reversibly couple with an external mixing motor, such that when the gear is coupled to the external mixing motor, the external mixing motor is operated to rotate the impeller.

According to another aspect of the present invention, there is provided a kit, comprising: an application device such as described above; and a docking station.

According to another aspect of the present invention, there is provided a kit, comprising: an application device such as described above; and a docking station comprising a mixing motor, wherein the application device and the docking station are configured to reversibly mutually couple to a coupled state, and in the coupled state, operation of the mixing motor leads to mixing fluid contents of the reservoir.

The docking station may be configured for at least one of: holding the application device in an upright position; charging a power storage component of the application device; acting as a control unit for at least one function of the application device; and weighing the contents of the reservoir.

Any one of the application devices described above, which comprises two separate reservoirs, may further comprise a cap configured to seal the first reservoir and the second reservoir.

BRIEF DESCRIPTION OF THE DRAWINGS

For better understanding of the invention and to show how the same may be carried into effect, reference will now be made, purely by way of example, to the accompanying drawings.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DETAILED DESCRIPTION OF PREFERRED EMBODIMENTS

Figure 1A:
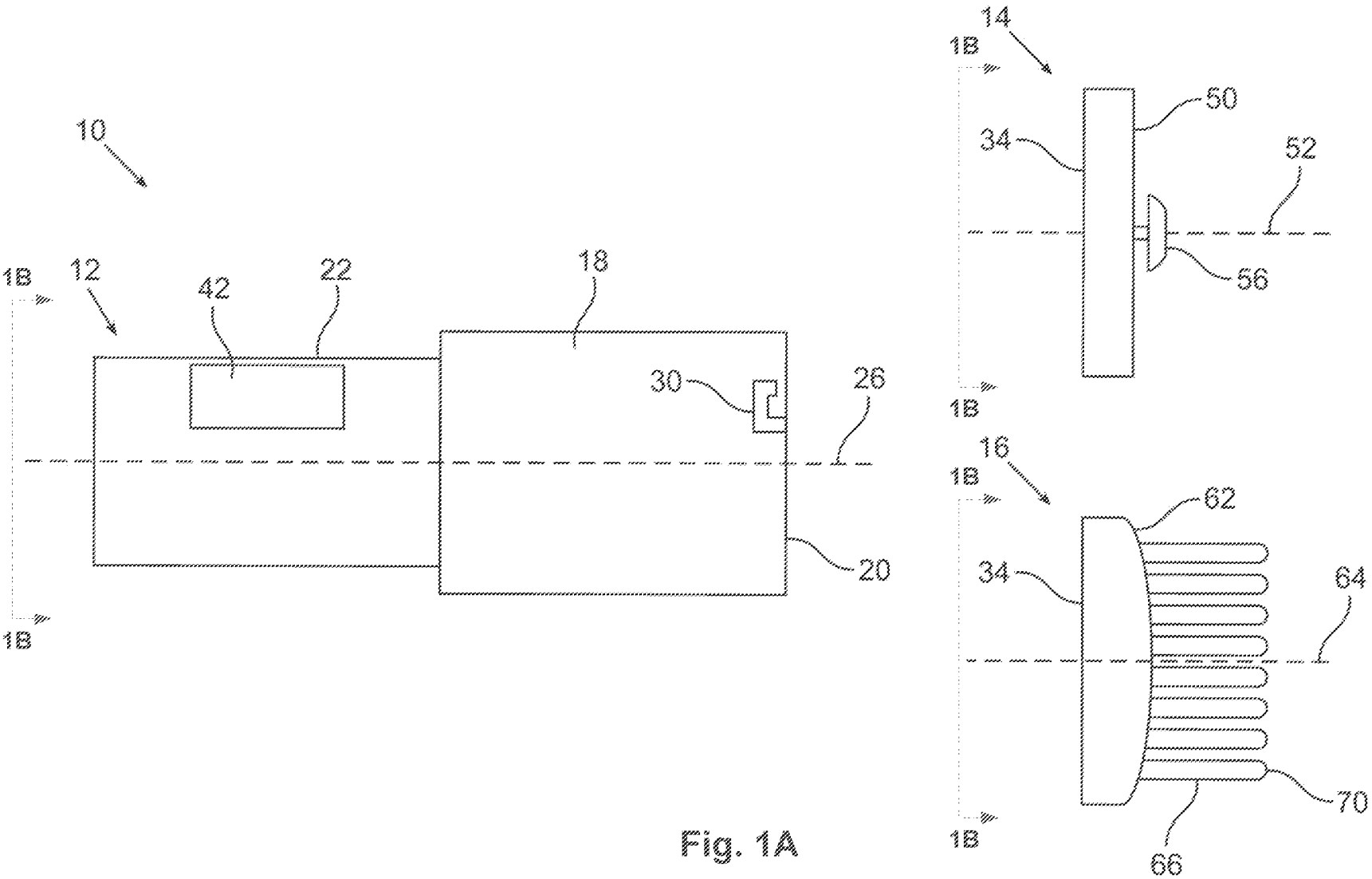
FIG. 1A schematically depicts an embodiment of an application device according to the teachings herein in side view.

Some embodiments of the invention relate to devices, kits and methods useful for applying hair-coloring compositions to hair, especially human hair.

The principles, uses and implementations of the teachings of the invention may be better understood with reference to the accompanying description and examples. Upon perusal of the description and examples present herein, one skilled in the art is able to implement the teachings of the invention without undue effort or experimentation.

Before explaining at least one embodiment of the invention in detail, it is to be understood that the invention is not necessarily limited in its application to the details of construction and the arrangement of the components and/or methods set forth herein. The invention is capable of other embodiments or of being practiced or carried out in various ways. The phraseology and terminology employed herein are for descriptive purpose and should not be regarded as limiting.

At the time of this writing, the most common hair coloring methods are based on applying quinone imine dyes to the hair, the methods implemented using a hair-coloring kit that includes two components, a coloring solution and a developer. The two components of the hair-coloring kit are mixed together to make a hair-coloring composition that is applied to hair to be colored. The composition remains in contact with the hair for a period of time (typically 30-45 minutes) during which dye molecules are trapped inside the hair shafts. At the end of the period of time, the hair is rinsed and/or washed to remove remnants of hair-coloring composition.

It is challenging to apply such a hair-coloring composition to hair growing from a scalp, especially to hair growing from one's own scalp. It is challenging to apply such a composition exclusively on the hair shafts near the scalp so, typically, the entire hair shaft must be contacted with hair-coloring composition which contact damages the hair leaving it limp and lifeless. As noted in the introduction, various devices and methods for applying hair-coloring compositions to the hair have been disclosed, but all such devices and methods have one or more disadvantages.

Some embodiments of the teachings herein relate to devices, kits and methods useful for applying hair-coloring composition to hair, especially to the lower portion of hair shafts growing from the scalp of a human head (commonly called, and may be used hereinbelow, the roots), that are devoid of some of the disadvantages of known devices and methods.

In the following description and accompanying figures are described specific embodiments of a number of devices according to the teachings herein, an application device and a docking station, that are useful for applying hair-coloring compositions to hair, especially to the roots of human hair. Taken together, an application device and a docking station constitute an embodiment of a kit according to the teachings herein. The use of any one of an application device or a docking station alone or both of the two devices together constitutes an embodiment of the method according to the teachings herein.

Figure 1B:
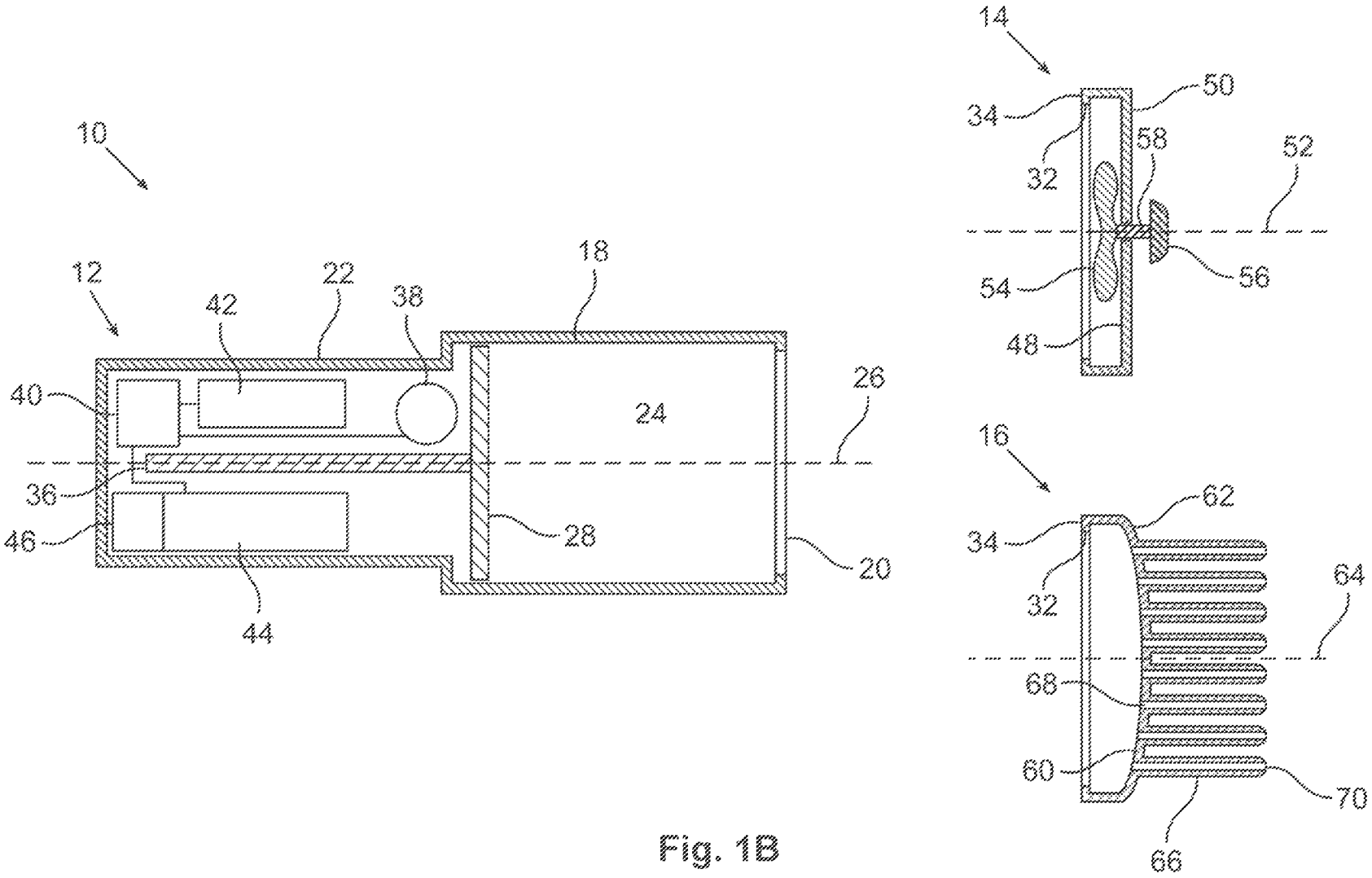
FIG. 1B schematically depicts an embodiment of an application device according to the teachings herein in side cross section taken along the plane 1B-1B of FIG. 1A.

FIG. 1A schematically shows a side view, and FIG. 1B schematically shows a side cross section of an application device 10 taken along the plane 1B-1B of FIG. 1A, according to embodiments of the present invention.

Application device 10 is depicted with three separate assemblies: barrel assembly 12, mixing cap 14 and application cap 16.

Barrel assembly 12 constitutes the device body of device 10 and includes a distal portion 18 with a distal end 20 and a proximal portion 22. Distal portion 18 is substantially a cylindrical wall that defines a cylindrical composition reservoir 24 (shown in FIG. 1B) with an axis 26. It will be appreciated that the device 10 is not limited to be cylindrical. In device 10, the reservoir axis and the body axis are both coaxial and therefore together depicted as axis 26. Reservoir 24 open at distal end 20 and which proximal end is defined by a distal face of piston 28 that is intended to sealingly slide back and forth in an axial direction inside reservoir 24. The dimensions of distal portion 18 are such that reservoir 24 has a desired maximal volume when piston 28 is in the most proximal position. For example, 110 ml to 150 ml. Preferably, barrel assembly 12 is water-resistant, that is to say, rinsing of the device (especially the reservoir) with running water does not damage barrel assembly 12 or any of its components. In some embodiments, barrel assembly 12 is waterproof, that is to say, suffers no damage if immersed in 1-meter-deep fresh water for 1 hour.

Both mixing cap 14 and application cap 16 are configured to reversibly connect to distal end 20 of barrel assembly 12. For example, the outer surface of distal end 20 of barrel assembly 12 may include at least one female element 30 of a twist-lock connector while the inner portions of both mixing cap 14 and application cap 16 may include corresponding male elements 32 of a twist-lock connector. From an unconnected state, a proximal end 34 of either mixing cap 14 or application cap 16 is placed over distal end 20 of barrel assembly 12 so that female and male elements 30 and 32 mate, and are then locked in place by twisting. As a result, reservoir 24 is sealed to prevent leakage of a viscous fluid such as hair-coloring composition from reservoir 24 at the interface between distal end 20 and the rims of mixing cap 14 or application cap 16.

It will be appreciated that the present invention is not limited to a male and female elements and any suitable method of connecting the mixing cap 14 or the application cap 16 to the barrel assembly 12 may be used.

Proximal portion 22 of barrel assembly 12 includes components required for operation of device 10 including at least some of a piston shaft 36, a piston-driving motor 38, an application controller 40 which may include a speaker, a display, a user interface 42, rechargeable power storage 44 and an inductive charger 46.

It will be appreciated that the proximal portion 22 is not limited to include the specific components described above and may include at least means for moving the piston (piston driving means or dispensing mechanism), a controller 40, means for operating the device 10 (device operating means), a rechargeable power storage 44 and means for recharging the rechargeable power storage (recharging means).

It will also be appreciated that the present invention is not limited to the exact components' location.

Proximal portion 22 of barrel assembly 12 is integrally-formed with distal portion 18 and constitutes a handle of device 10, that is to say, is shaped and dimensioned to serve as a handle for one-handed use by a human user. During use, of device 10 a human grasps proximal portion 22 with a hand so that the hand encircles proximal portion 22 and axis 26. In other embodiments of a device according to the teachings herein, a proximal portion has other shapes and/or cross sections. Generally, the length of a proximal portion of a barrel assembly of a device according to the teachings herein is defined both by the need to serve as a handle and to be of a sufficient size to contain the required components. For example, in device 10, the length of barrel assembly 12 is defined, inter alia, by the length of piston shaft 36.

Display/user interface 42 may be a standard touch screen known in the art and is used to provide user commands to application controller 40 and to visually display, to a user, information from application controller 40. Application controller 40 may be a digital controller (e.g., PCB) as known in the art of home appliances and microcomputing and may be configured to receive user commands via display/user interface 42, to provide information and feedback to a user via display/user interface 42 and to control other components of application device 10, for example, operation of piston-driving motor 38 in order to move piston 28 in a distal and proximal direction. Depending on the specific embodiment, some specific tasks which controller 40 is configured to do may optionally include one or more of:

- turn device 10 on or off;
- accept user instruction to move piston 28 back (in a proximal direction to increase the volume of reservoir 24) to a maximal extent;
- accept user instruction to move piston 28 forward (in a distal direction to decrease the volume of reservoir 24) to a maximal extent;
- accept user instruction to move piston 28 forwards at predetermined and/or user-selected rate, e.g., useful for dispensing hair-coloring composition held in reservoir 24;
- pause movement of piston 28;
- use display/user interface 42 and/or the associated speaker to indicate to a user how much composition is found in reservoir 24;
- indicate that power storage 44 is being charged or is fully charged;
- indicate the fact that power storage 44 is insufficiently charged to completely apply the contents of the composition reservoir (in some embodiments, application controller 40 is configured so that if power storage 44 is insufficiently charged to completely apply the contents of composition reservoir 24, piston 28 cannot be moved to dispense hair-coloring composition, thereby avoiding a user having only partially-colored hair).

Mixing Cap

In some embodiments, an application device according to the teachings herein is provided with a mixing cap 14, configured to connect, preferably reversibly, to the barrel assembly 12 of the application device 10. In some such embodiments, when the mixing cap 14 is not connected to the barrel assembly 12, the reservoir 24 is accessible allowing addition of components of a hair-coloring composition into reservoir. In some such embodiments, when the mixing cap is connected to the barrel assembly 12, composition held in the reservoir 24 can be mixed.

In device 10, mixing cap 14 includes proximal end 34, a proximal face 48, a distal face 50 and an axis 52. Apparent on proximal face 48 is an impeller 54, the stirring component of device 10. Apparent on distal face 50 is an engaging component, gear 56. Impeller 54 and gear 56 are mutually connected by rod 58 that serves as a stirring shaft of device 10 passing from distal face 50 to proximal face 48 through mixing cap 14. Rod 58 is sealingly rotatably mounted in mixing cap 14 to be coaxial with axis 52, thereby allowing impeller 54, gear 56 and rod 58 to coaxially rotate but preventing leakage of a fluid such as hair-coloring composition passing from proximal face 48 to distal face 50 along the length of rod 58.

Application Cap

An application device according to the teachings herein is provided with an application cap 16, preferably configured to connect, more-preferably reversibly connect, to the barrel assembly 12 of the application device 10. In some such embodiments, when the application cap 16 is not connected to the barrel assembly 12, the reservoir 24 is accessible allowing addition of components of a hair-coloring composition into the reservoir.

In device 10, application cap 16 includes proximal end 34, a proximal face 60, a distal end 62, an axis 64 and a plurality of coplanar elongated application tines 66 that protrude substantially axially (in some embodiments within 30°, within 25°, within 20°, within 15°, within 5° of parallel and even parallel with axis 64 and with reservoir axis 26 when application cap 16 is connected to barrel assembly 12). Application cap 16, as presented, includes eight tines 66. In some preferred embodiments, a device according to the teachings herein may include at least 3 tines (allowing adequate dispensing of hair-coloring composition) and not more than 10 tines (avoiding too-great resistance to pushing the tines through the hair and ensuring that all the tines remain in contact with the scalp, see below). Accordingly, in some preferred embodiments, a device according to the teachings herein has 3, 4, 5, 6, 7, 8, 9 or 10 tines. Nevertheless, it will be appreciated that the present invention is not limited to 3 to 10 tines.

Each tine 66 is hollow and includes a composition channel 68 that provides fluid communication from proximal face 60 through a distal tip 70 of tine 66. Distal tips 70 of tines 66 are non-scratching being rounded and have a diameter of not less than 2 mm and not more than 4 mm. In preferred embodiments, the diameter is not more than 3.5 mm and even not more than 3 mm. It will be appreciated that the present invention is not limited to these diameters.

The cross-sectional shape of the composition channel 68 at a distal tip 70 of tines 66 is any suitable shape, preferably a circle. The cross-sectional size of the composition channel 68 at a distal tip 70 of tines 66 is any suitable size, in some embodiments between 1 mm and 2 mm.

Tines 66 are typically not less than 2 cm long, preferably not less than 2.5 cm long and not more than 8 cm long, more preferably not more than 6 cm long. Tines 66 are slightly axially elastically flexible, i.e., a force that is manually-applied to the side of a distal tip 70 perpendicular to the axial direction while application cap 16 is held immobile bends the tine so that the tip is displaced by up to 3 mm. A person having ordinary skill in the art is able to manufacture an application cap such as 16 with tines 66 having the required properties without inventive effort using standard methods (e.g., injection molding) and using standard materials such as polypropylene.

The separation between two neighboring tines 66 measured from the center of two neighboring tips is between 4 mm and 8 mm, more preferably not less than 5 mm and not more than 7 mm. In preferred embodiments, composition channels 68 are such that a fluid such as hair-coloring composition that passes through a channel 68 of a tine 66 from proximal face 60 emerges from a corresponding distal tip 70 in a direction parallel to axis 64.

Docking Station

Some embodiments of the teachings herein relate to a docking station. In some embodiments, an application device according to the teachings herein is used together with a docking station, or is provided together with a docking station as two components of a hair-coloring kit. Specifically, in some preferred embodiments, a docking station according to the teachings herein constitutes a holder for stably holding a barrel assembly of an application device distal end up. While the barrel assembly is held by the holder, a hair-coloring composition or components thereof may be added into the composition reservoir if the composition reservoir is open, e.g., for application device 10 neither mixing cap 14 or application cap 16 is attached to barrel assembly 12 so that reservoir 24 is open through distal end 20. In some embodiments, while the barrel assembly is held by the holder, a mixing cap can be coupled to the distal end of the application device to seal the reservoir. In some embodiments, the docking station is configured to mix the contents of a reservoir of a barrel assembly when the mixing cap is coupled therewith.

Figure 2B:
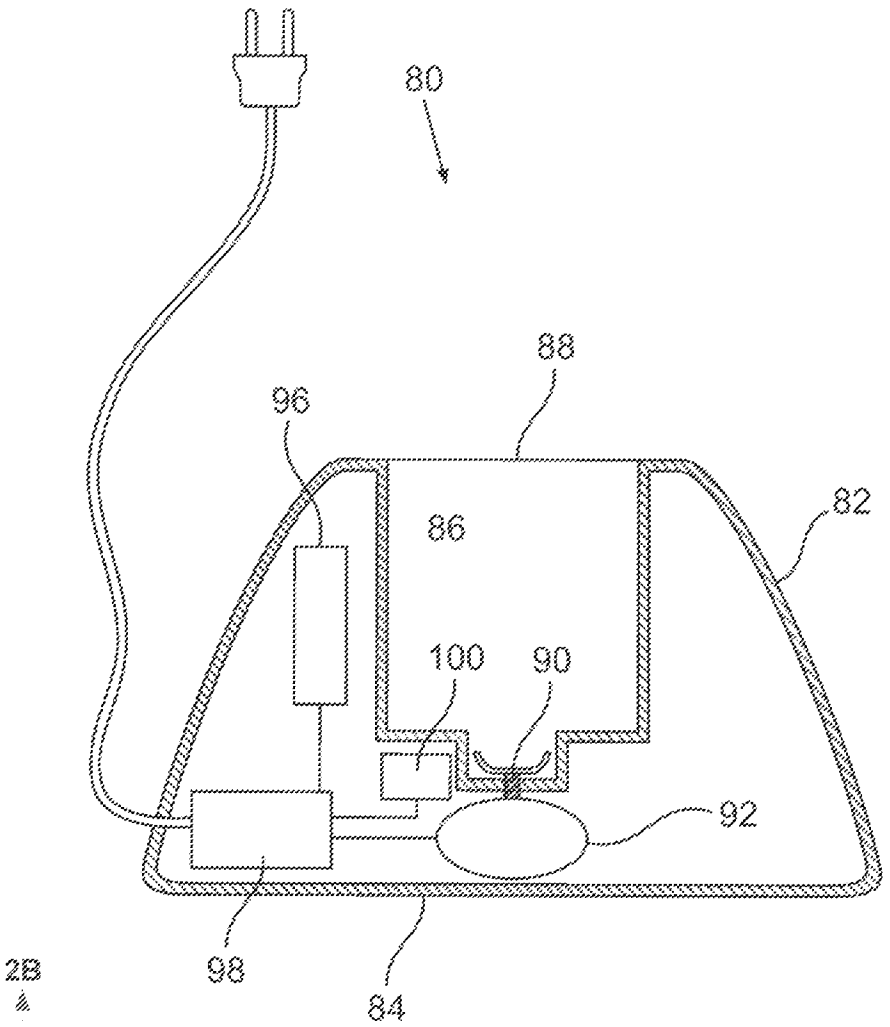
FIG. 2B schematically depicts an embodiment of a docking station according to the teachings herein in side cross section taken along the plane 2B-2B of FIG. 2A.
Figure 2A:
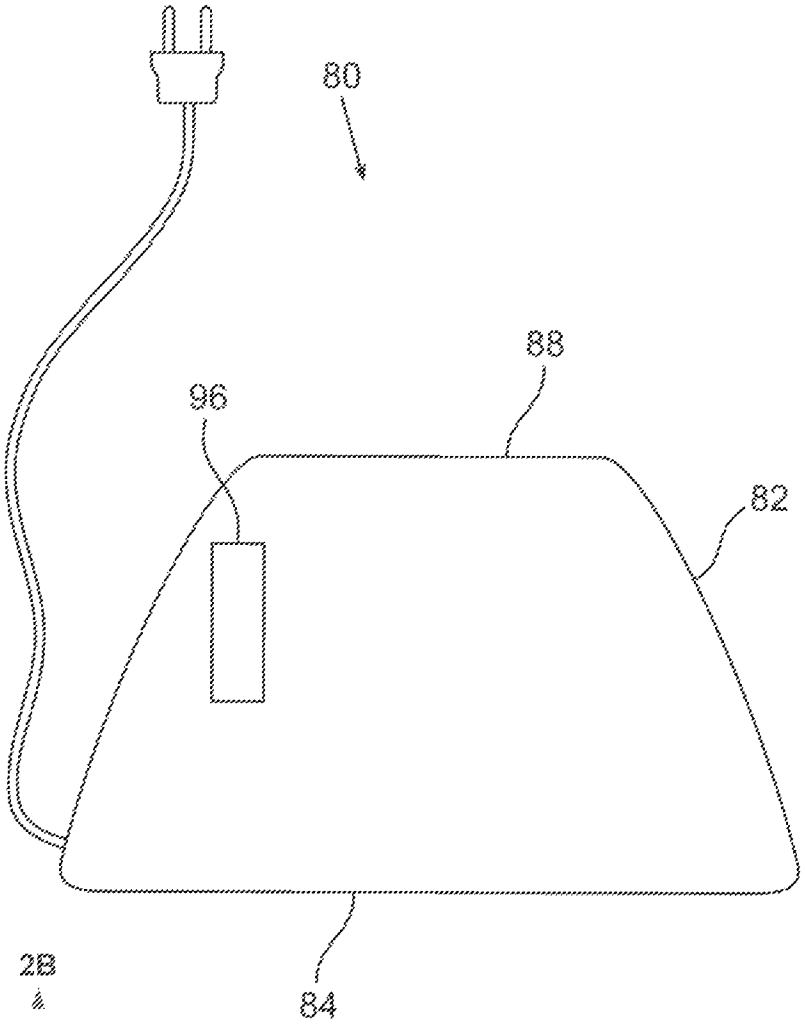
FIG. 2A schematically depicts an embodiment of a docking station according to the teachings herein in side view.

FIG. 2A schematically shows a side view, and FIG. 2B schematically shows a side cross section, taken along the plane 2B-2B of FIG. 2A, of a docking station 80 for use together with application device 10, according to embodiments of the present invention.

Docking station 80 comprises a body 82, a base 84, a cavity 86 and an opening 88 to the cavity opposite base 84. When base 84 of docking station 80 is placed on a flat surface such as a table, opening 88 is directed upwards. Docking station 80 further comprises a recessed stirring gear 90 at the bottom of cavity 86. Inside body 82 are also a mixing motor 92 configured to rotate stirring gear 90 when activated, an on/off switch 96, a power supply 98 and an inductive charger 100. It will be appreciated that the present invention is not limited to an inductive charger and any suitable charger may be used with the required modifications. For example, a physical connector may connect the charger with the device 10.

Cavity 86 and opening 88 together constitute the holder of docking station 80, configured in terms of size, shape and dimensions to stably hold barrel assembly 12 with distal end 20 oriented either upwards or downwards while mixing cap 14 is attached thereto. Specifically, the diameters of opening 88 and cavity 86 are only slightly bigger than the diameter of mixing cap 14 and the depth of cavity 86 is slightly more than the length of proximal portion 22.

Docking station 80 is configured so that when on/off switch 96 is set to "on" and the application device 10 with the attached mixing cap 14 is held in cavity 86, mixing motor 92 starts operating to turn stirring gear 90 for a predetermined time, e.g., 30 seconds, thereby rotating gear 56 which rotates impeller 54 which stirs the composition inside reservoir 24.

Use of Application Device 10 and Docking Station 80 for Coloring Hair

Figure 3:
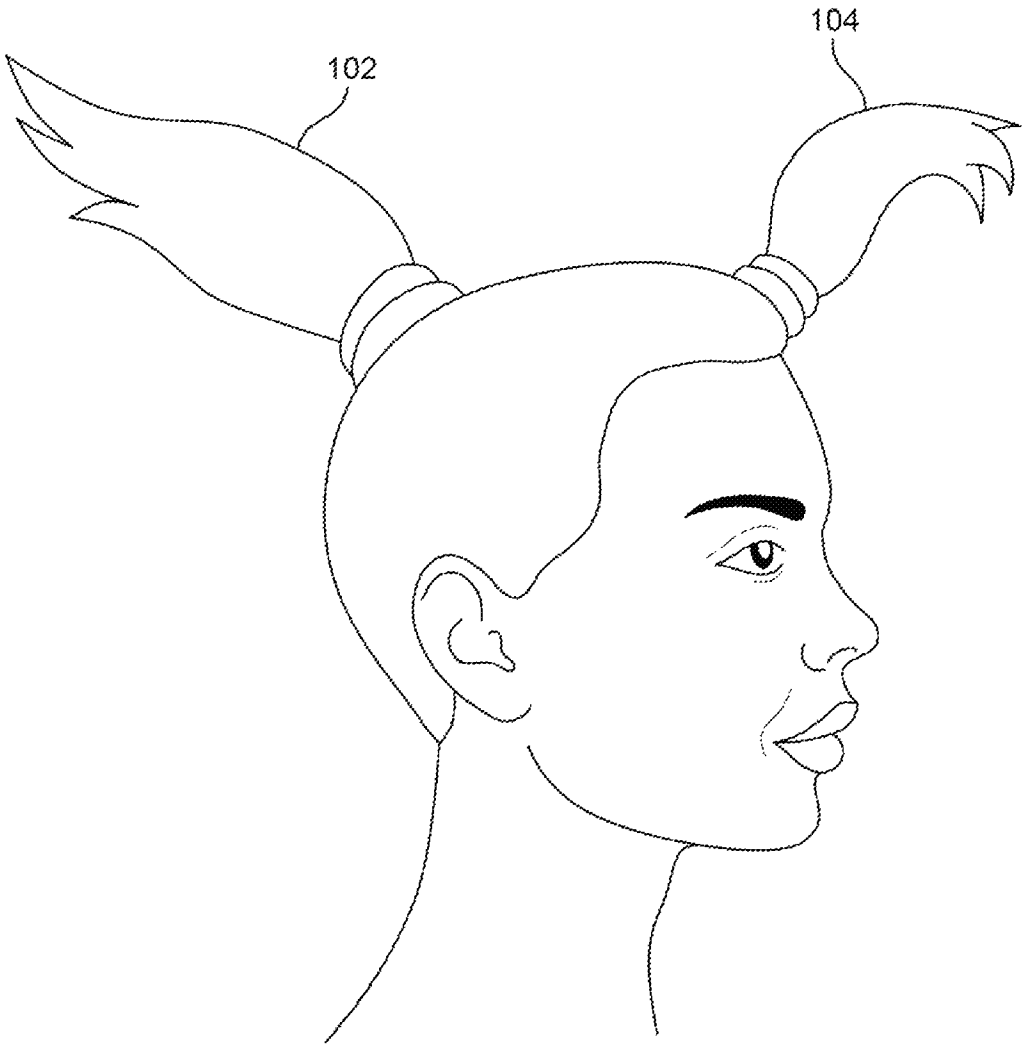
FIG. 3 depicts the head of a person ready to have hair-coloring composition applied to their hair, in side view.

According to embodiments of the present invention, in preparation for application of hair-coloring composition, the hair of a subject whose hair is to be dyed is tied into one or more ponytails so as to gather the hair shafts together and expose the scalp and hair roots, for example, into two pony tails along the centerline of the head, see FIG. 3: a first ponytail 102 extending backwards from hair gathered from the back of the head and centered around the crown of the head and a second ponytail 104 extending forwards from the hair gathered from the front of the head.

For use, docking station 80 is placed on a surface (e.g., a table).

Display/user interface 42 of barrel assembly 12 is used to provide application controller 40 with a command to activate motor 38 to bring piston 28 to a most proximal position where reservoir 24 has a greatest volume.

Barrel assembly 12 is placed into cavity 86 of docking station 80 through opening 88 so that proximal portion 22 is completely inside cavity 86 and the proximal part of distal portion 18 contacts the walls of opening 88. As a result, barrel assembly 12 is stably held, distal end 20 faces upwards with axis 26 nearly perpendicular to the surface. Charger 46 of barrel assembly 12 and charger 100 are thereby mutually positioned so that power storage 44 of barrel assembly 12 is charged with power from power supply 98 of docking station 80.

While distal end 20 is open, the two components of a hair-coloring composition are added by pouring into reservoir 24 and mixing cap 14 is attached to distal end 20 as described above. Barrel assembly 12 and mixing cap 14 are removed as one unit from docking station 80, turned over and then placed back into cavity 86 of docking station 80 (mixing cap 14 first) so that gear 56 of mixing cap 14 engages stirring gear 90 of docking station 80 and barrel assembly 12 is stably held, proximal end upwards with axis 26 perpendicular to the surface. As a result, rod 58 and impeller 54 of mixing cap 14 are coupled to mixing motor 92 through the engagement of gear 56 with stirring gear 90.

A user uses on/off switch 96 to activate mixing motor 92 to rotate stirring gear 90 which rotates gear 56, rod 58 and impeller 54. The rotation of impeller 54 is of a sufficient duration and intensity to ensure that the contents of reservoir 24 are well-mixed and constitute a hair-coloring composition.

Subsequently, barrel assembly 12 and mixing cap 14 are removed together from docking station 80, turned over and barrel assembly 12 is placed into cavity 86 through opening 88 so that proximal portion 22 is completely inside cavity 86 and the proximal part of distal portion 18 contacts the walls of opening 88 so that barrel assembly 12 is stably held, distal end 20 faces upwards with axis 26 nearly perpendicular to the surface. Again, charger 46 of barrel assembly 12 and charger 100 are thereby mutually positioned so that power storage 44 of barrel assembly 12 is charged with power from power supply 98 of docking station 80.

Mixing cap 14 is separated from barrel assembly 12 and rinsed or discarded.

Application cap 16 is attached to distal end 20 as described above. Barrel assembly 12 and application cap 16 are removed as one unit from docking station 80 and held by a user who grasps proximal portion 22 with his/her hand.

The user uses display/user interface 42 of application device 10 to activate application controller 40 to activate motor 38 to move piston 28 distally to remove any air trapped in reservoir 24 and optionally in channels 68 of tines 66. In some embodiments, this is done manually, for example, by the user looking when composition reaches the tips of tines 66. In other embodiments, an increase of resistance to distal movement of piston 28 is sensed by controller 40 indicating that all air has been expelled and that hair-coloring composition is starting to be forced into channels 68.

The user then uses display/user interface 42 of application device 10 to activate application controller 40 to activate motor 38 to move piston 28 in a distal direction to force hair-coloring composition from reservoir 24 into channels 68 and out through distal tips 70 of tines 66 at a rate (preferably a user-selected rate) that is suitable for coloring hair.

While the composition is being forced out through distal tips 70 of tines 66, the user moves device 10 and application cap 16 in a distal direction parallel to axis 26, while maintaining distal tips 70 in tangential contact (typically an angle of not more than 45°, preferably not more than 30°) with the scalp.

The non-scratching rounded distal tips 70 slide along the scalp and do not scratch or cause discomfort to the scalp. According to embodiments of the present invention, the tines are flexible thereby allowing alignment of tines 70 to conform to the curvature of the scalp so that all of tines 70 contact the scalp. Importantly, hair-coloring composition is continuously expelled from distal tips 70 of tines 66 and pushed to either side of the distal tip due to a "snowplow" effect. Without wishing to be held to any one theory, it is currently believed that with the correct distal tip width and inter-tine separation (as discussed above with reference to application cap 16 of device 10), expelling the composition along the hair shafts near the scalp from the distal tip together with the described snowplow effect leads to highly effective application of composition to the portions of the hair shafts that are close to the scalp that are to be colored by application of hair-coloring composition.

The user continues applying composition as described above for as long as desired. When reservoir 24 is 25%, 50%, 75% and 95% empty, application controller 40 may optionally use the speaker to emit a warning tone (or any other visual indicator such as LED display showing the position of the piston hence the amount of hair-coloring material left in the reservoir 24).

If hair-coloring composition remains in reservoir 24 when application is complete, the user may use the device's operating means to activate controller 40 which activates piston 28 to remove the remaining composition and the composition is discarded, e.g., into a sink. Alternatively, when application is complete, the user may separate application cap 16 from barrel assembly 12 and rinse the two assemblies including washing out excess composition from reservoir 24 using water.

According to embodiments of the present invention, mixing cap 14 may be rinsed or discarded and application cap 16 may be rinsed or discarded.

Reservoir 24, distal end 20 and the distal face of piston 28 of barrel assembly 12 are rinsed and placed in docking station 80 to dry and/or recharge and/or for storage.

The user, in the usual way, leaves the composition on the hair for a desired period of time. In some embodiments, application controller 40 works as a timer and provides indication when a desired period of time has passed.

After the desired period of time, the hair is rinsed and/or washed of excess composition.

Figure 4:
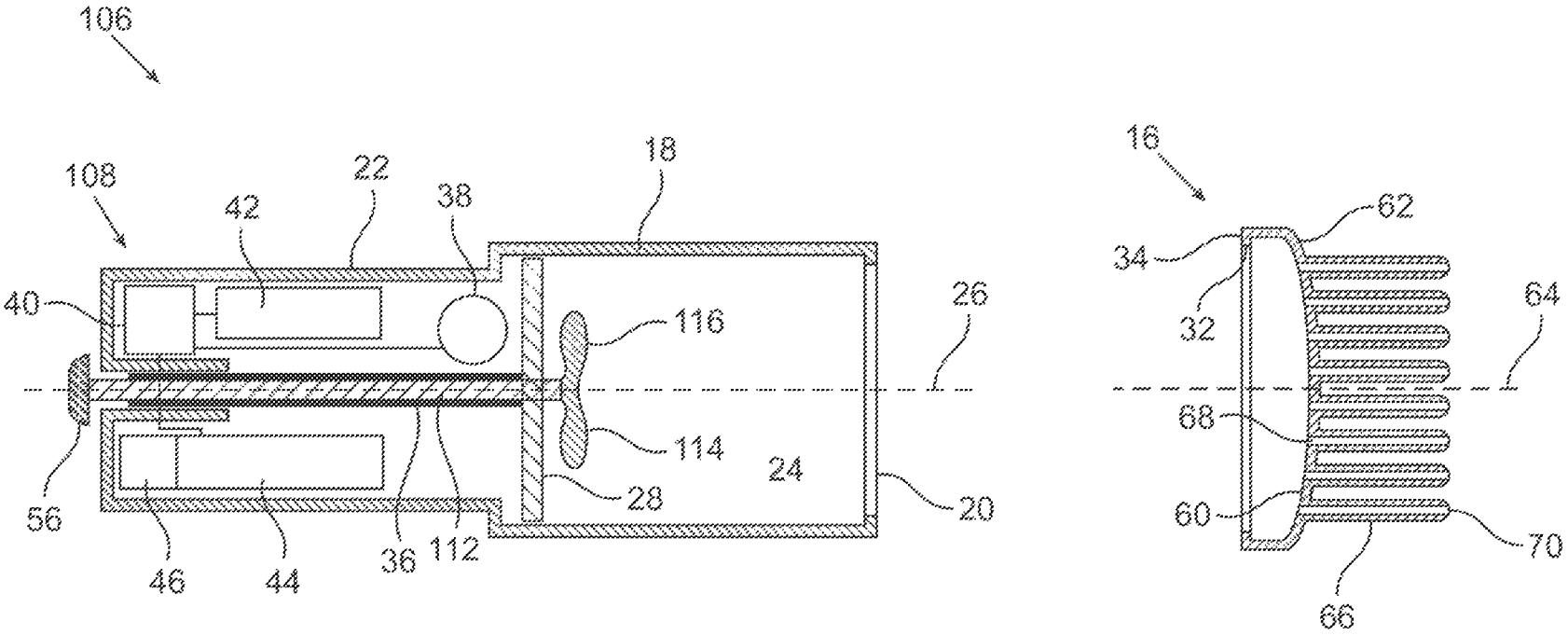
FIG. 4 schematically depicts an embodiment of an application device according to the teachings herein in side cross section taken along a plane similar to 1B-1B of FIG. 1A.

FIG. 4 schematically shows a side cross section, taken along a plane similar to 1B-1B of FIG. 1A, of another application device 106, according to embodiments of the present invention. In many aspects and details, application device 106 is similar or identical to application device 10 discussed above. Some of the differences between device 10 and device 106 are discussed below.

In FIG. 4, application device 106 is depicted with two reversibly-couplable assemblies: barrel assembly 108 and application cap 16.

In addition to the components that are similar or identical to the ones discussed above in conjunction with barrel assembly 12 of device 10, barrel assembly 108 includes a gear 56, a rotatable shaft 112 functionally associated with gear 56 and a collapsible impeller 114 that functions as a stirring component of device 106.

Rotatable shaft 112 is an elongated cylinder (e.g., of stainless steel) that is rotatable mounted inside and coaxial with piston shaft 36. Gear 56 is secured to the proximal end of shaft 112 while impeller 114 is secured to the distal end of shaft 112 so as to extend from the distal face of piston 28 into reservoir 24 to be located inside reservoir 24.

Like gear 56 of mixing cap 14 of device 10, gear 56 of device 106 is configured to couple with a corresponding stirring gear, such as stirring gear 90 of an appropriately-configured docking station, such as docking station 80 depicted in FIGS. 2A and 2B.

Impeller 114 is shaped to stir a fluid such hair-coloring composition held in composition reservoir 24 when rotated. According to embodiments of the present invention, impeller 114 may be a collapsible impeller which has at least two states: an uncollapsed stirring state and a collapsed state. In the uncollapsed stirring state, collapsible impeller 114 has an uncollapsed height dimension along axis 26 in which state the shape of collapsible impeller 114 is suitable for stirring a fluid such hair-coloring composition held in composition reservoir 24 when collapsible impeller 114 is rotated. In the collapsed state, collapsible impeller 114 has a collapsed height dimension along axis 26 which is smaller than the uncollapsed height dimension. Transition from the uncollapsed stirring state to the collapsed state is accomplished, for example, by application of a proximal direction force to a distal end 116 of collapsible impeller 114. Transition from the collapsed state to the uncollapsed stirring state is accomplished, for example, as a result of inherent elasticity of collapsible impeller 114 or when collapsible impeller 114 is rotated through rotatable shaft 112, e.g., as a result of the centrifugal force caused by the rotation, or by the force applied by a fluid inside 24 to collapsible impeller 114 when collapsible impeller 114 is rotated.

In some embodiments, a collapsible impeller is made of silicone rubber that is ordinarily shaped similar to mixer blades of a commercial stick mixer, but is elastically deformable to a thin flat shape on application of a force in a distal direction. Accordingly, in some embodiments, a collapsible stirring component such as collapsible impeller 114 is at least partially fashioned from a material sufficiently flexible and elastic (such as silicone rubber) so that the stirring component adopts the collapsed state when the force is applied, e.g., the impeller is pressed against a proximal face 60 of an application cap 16. Additionally or alternatively, in some embodiments a collapsible stirring component comprises at least one hinge so that the stirring component adopts the collapsed state when the force is applied, e.g., the impeller is pressed against a proximal face 60 of an application cap 16, by a rotation around such a hinge.

For use of device 106, barrel assembly 108 is placed inside a cavity 86 of an appropriate docking station 80 proximal end, first when piston 3628 is at a most distal position so that gear 56 couples with stirring gear 90 of docking station 80. Precursors of a hair-composition are placed inside composition reservoir 24 and application cap 16 attached to barrel assembly 108 as described above.

When docking station 80 is activated, stirring gear 90 rotates gear 56, which rotates shaft 112 which rotates the impeller 114. If the impeller is collapsible, since there is no substantial force applied to distal end 116, the collapsible impeller is in an uncollapsed state and stirs the contents of composition reservoir 24, thereby making a hair-coloring composition.

The hair-coloring composition is then applied to hair as described above. Near the end of the application of the hair-coloring composition, piston 28 nears a proximal face 60 of application cap 16 such that distal end 116 of collapsible impeller 114 contacts proximal face 60. Further distal advancement of piston 28 by motor 38 creates a force on distal end 116 of collapsible impeller 114 so that collapsible impeller 114 starts to collapse in a proximal direction from the uncollapsed stirring state with an uncollapsed height dimension to the collapsed state with a collapsed height dimension. As a result, most if not all of the hair-coloring composition held in composition reservoir 24 is applied.

Figure 5A:
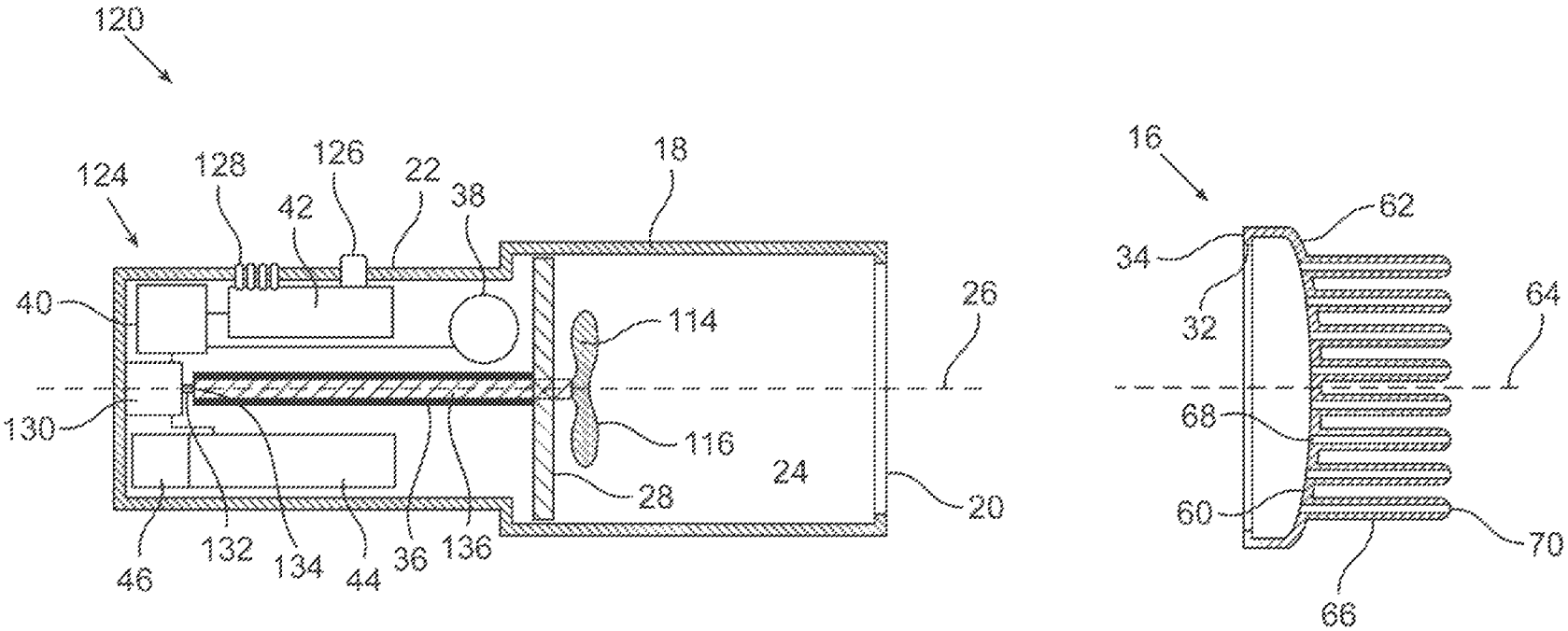
FIG. 5A schematically depicts an embodiment of an application device according to the teachings herein in side cross section taken along a plane similar to 1B-1B of FIG. 1A.
Figure 5B:
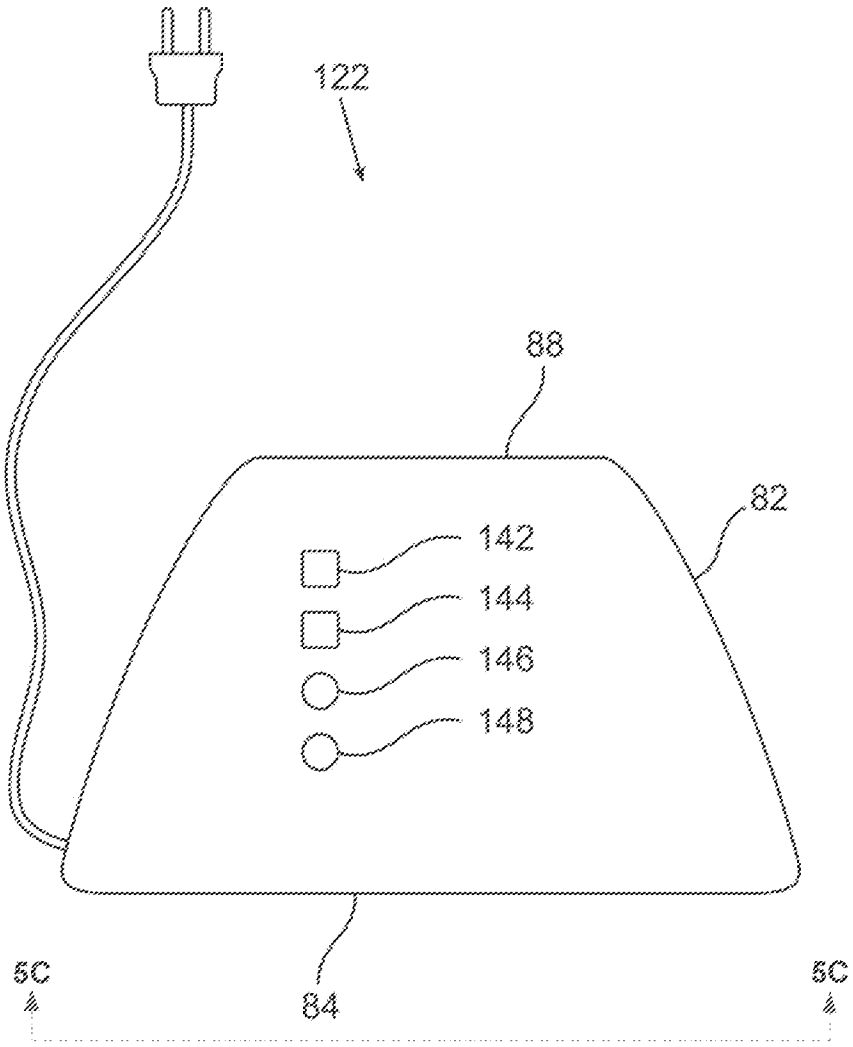
FIG. 5B schematically depicts an embodiment of a docking station according to the teachings herein in side view.
Figure 5C:
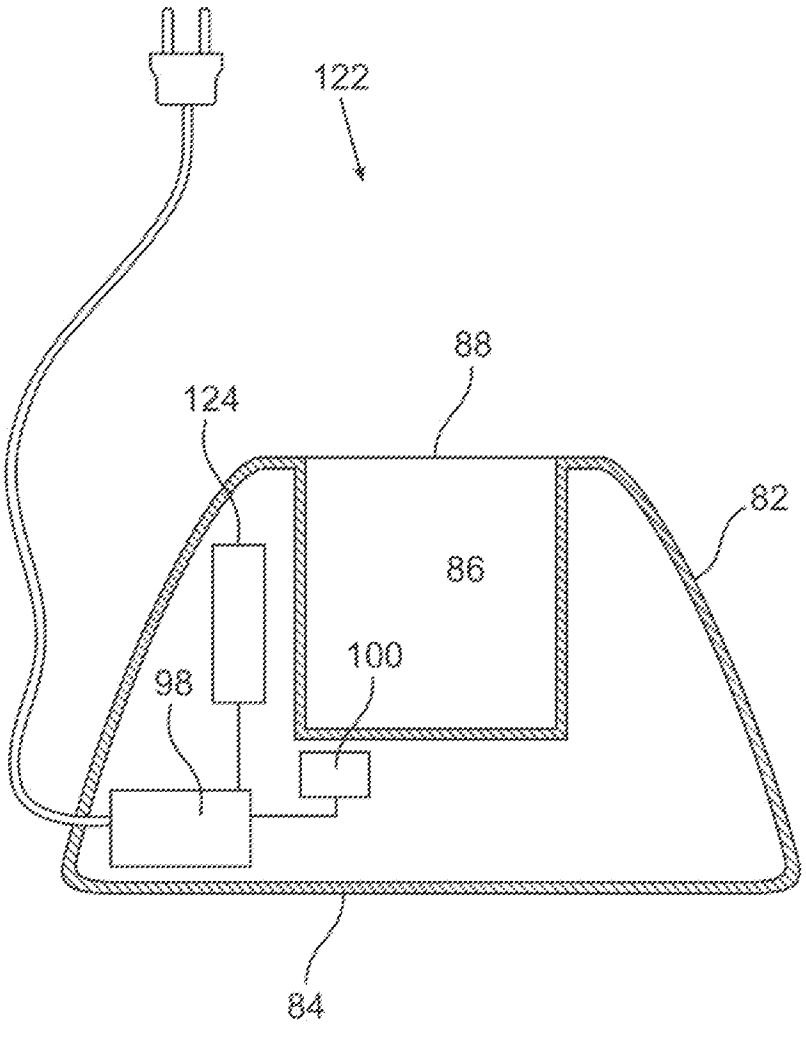
FIG. 5C schematically depicts an embodiment of a docking station according to the teachings herein in side cross section taken along the plane 5C-5C of FIG. 5B.

An additional embodiment of a kit according to the teachings herein, comprising an application device 120 and a docking station 122, is depicted in FIG. 5:

FIG. 5A schematically shows a side cross section of another application device 120, taken along a plane similar to 1B-1B of FIG. 1A;

FIG. 5B schematically shows a side view of another docking station 122; and FIG. 5C schematically shows a side cross section of docking station 122 taken along the plane 5C-5C of FIG. 5B.

In many aspects and details, application device 120 is similar or identical to application devices 10 and 106 discussed above. Some of the differences between device 120 and devices 10 and 106 are discussed below. In many aspects and details, docking station 122 is similar or identical to docking station 80 discussed above. Some of the differences between docking station 122 and docking station 80 are discussed below.

In FIG. 5A, application device 120 is depicted in side cross section, taken along a plane similar to 1B-1B of FIG. 1A, with two reversibly-couplable assemblies: a barrel assembly 124 and application cap 16. Barrel assembly 124 includes a distal portion 18 that defines a composition reservoir 24 and a proximal portion 22 that constitutes a handle of device 120.

According to embodiments of the present invention, the barrel assembly 124 may comprise a spring-loaded activation button 126 ordinarily biased in an outwards state but can be depressed to an inwards state by application of a force with the fingers or hands. When application cap 16 is attached to barrel assembly 124 and button 126 is in the inwards state, a motor 38 drives a piston 28 distally to dispense composition held in composition reservoir 24 through application tines 66 of an application cap 16. When button 126 is released from the inwards state, it returns to the outwards state and motor 38 is momentarily reversed then stopped. As a result, piston 28 is withdrawn a little in a proximal direction. As a result, release of button 126 results in an immediate suspension of dispensing of composition through tines 66. The activation of piston-driving motor 38 in accordance with the state of button 126 is by an application controller 40. It will be appreciated that other types of activation buttons may be used and the present invention is not limited to a spring-loaded activation button.

A LED array 128 made up of individually-activatable light-emitting diodes, e.g., 4, is used to indicate the amount of composition held in the composition reservoir: e.g., all LEDs lit indicating that composition reservoir 24 is full, less LEDs lit indicating that composition reservoir 24 is partially full, e.g., 75%, 50%, 25%, 12.5%—one LED blinks every 2 seconds, 6%—one LED blinks every second and all LEDs blink a few times may indicate that composition reservoir 24 is empty. The activation of LED array 128 is by application controller 40. Device 120 includes a mixing motor 130 with a rotating shaft 132 having a toothed-gear 134 at the distal end thereof as components of barrel assembly 124. When piston 28 is in a most proximal position (as depicted in FIG. 5A), gear 134 is inside the bore of hollow shaft 136 and the teeth of gear 134 mesh with internal teeth found inside the bore of hollow shaft 136. When device 120 is coupled with docking station 122, mixing motor 130 can be activated to rotate, thereby rotating shaft 132, gear 134, hollow shaft 136 and collapsible impeller 114. Specifically, in the depicted embodiment mixing motor 130 is powered directly from a docking station 122 and not by the batteries (power storage 44) of device 120. In alternative embodiments, the mixing motor 130 is optionally or exclusively powered by the integral power storage component of the barrel assembly 124.

Docking station 122 is schematically depicted in FIG. 5BC (side cross section) and 5CB (side view).

FIG. 5B shows a body 82, a base 84, a cavity 86, an opening 88, a power supply 98, an inductive charger 100 and a docking station controller 124 that activates all the functions and components of docking station 122. As mentioned above, the present invention is not limited to an inductive charger and any suitable charger may be used with the required modifications. For example, a physical connector may connect the charger with the device 120.

FIG. 5C shows an exemplary outside of docking station 122 comprising two buttons 142 and 144 and two indicator LEDs 146 and 148.

A stirring activation button 142, when depressed, causes controller 124 to activate a mixing motor 130 of a device 120 coupled with docking station 122. This is achieved, for example, that upon depression of button 142, controller 124 modulates the power transferred from inductive charger 100 of docking station 122 to inductive charger 46 of barrel assembly 124 which modulation is detected by controller 40 of barrel assembly 124.

A reset button 144 that, when depressed, causes controller 124 to instruct a device 120 coupled with docking station 122 to bring piston 28 to the most proximal position. This can be achieved, for example by modulation of the transferred power as noted above. Alternatively or additionally, in some embodiments, a reset button with same functionality as reset button 144 is found on the barrel assembly (12, 108, 124, 610A, 710, 810, 910 and 1010 which will be described in details below).

A charging indicator LED 146 that flashes when a device 120 is coupled with docking station 122 and charging via inductive charger 46 (or in some embodiments, a direct contact charger) and that stops flashing and is lit constantly when the batteries of device 120 are charged sufficiently to dispense the entire contents of the composition reservoir of device 120.

A power indicator LED 148 that is lit when docking station 122 is connected to an electrical source.

In an alternate embodiment, a docking station includes a single button with two integrated LEDs, a red LED and a green LED. When an application device is held in the docking station, is charging and there is insufficient charge in the power storage of the application device for dispensing the entire contents of the reservoir, the red LED flashes. Nothing happens when the button is pressed. When the power storage of the application device is sufficiently charged to dispense the entire contents of the reservoir, the red LED is extinguished and the green LED is lit. When the green LED is lit, pressing the button leads to activation of the stirring mechanism to stir the contents of the reservoir.

According to embodiment of the present invention, any one of the above-described application devices 10, 106 and 120 may be intended to receive or encompass, inside reservoir 24, a hair-coloring composition cartridge or capsule.

For device 10, the capsule may be, for example, a collapsible or breakable capsule separated into two cavities each comprising a different part of the hair-coloring composition, e.g., peroxide and coloring paste. The separation between the cavities may be snapped by the user which than shakes the capsule in order to uniformly mix the hair-coloring composition. The capsule may then be inserted into the reservoir 24 and the device may operate as described above. When the piston 28 is pushed towards the tines, the capsule snaps allowing the hair-coloring composition to be pushed towards the tines.

For devices 106 and 120, the capsule may be, for example, a collapsible or breakable capsule separated into two cavities each comprising a different part of the hair-coloring composition. When the capsule is inserted into the reservoir 24, the separation between the cavities may be snapped by the impeller 114 which is in contact with the lower side of the capsule in order to uniformly mix the hair-coloring composition. The device may then operate as described above. When the piston 28 is pushed towards the tines, the hair-coloring composition is pushed towards the tines. It will be appreciated that the capsules described above are only examples and any capsule which enables mixing of the hair-coloring composition and delivering it through the tines may be used. The capsule body, upper side and lower side may be made, for example, from a collapsible material, foldable material, dissolvable material etc. The upper and/or lower sides of the capsules may be covered by a removable cover, e.g., foil, which enables opening of the capsule prior to insertion into the reservoir 24. It will be appreciated that the capsule may be inserted into reservoir 24 when the reservoir opening faces upwards or when the reservoir opening faces downwards and then flipped by the user along with the capsule.

Figure 6A:
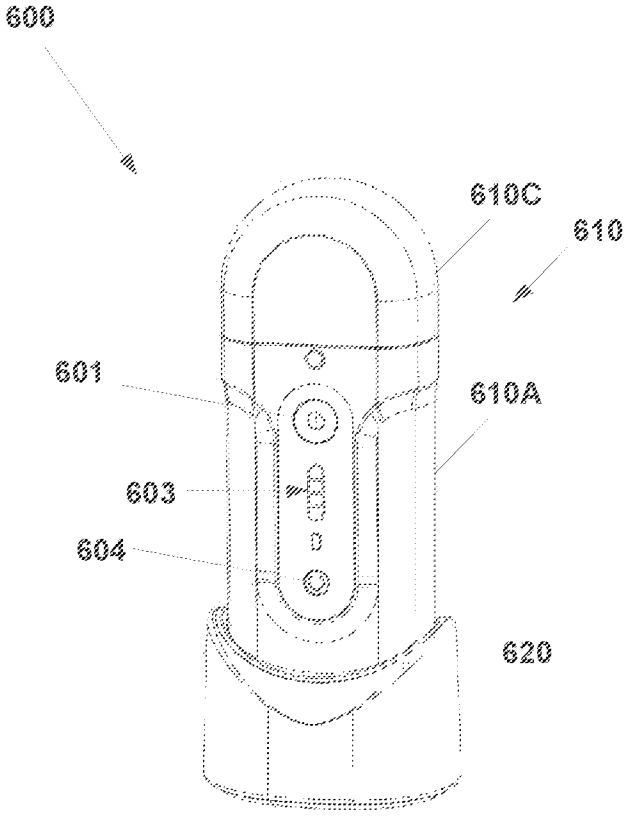
FIG. 6A schematically depict an embodiment of a kit including an application device and a corresponding docking station according to the teachings herein.

An additional embodiment of a kit 600 according to the teachings herein, comprising an application device 610 and a docking station 620, is depicted in FIG. 6:

FIG. 6A shows a front view of another application kit 600 comprising another docking station 620; and another application device 610 comprising a barrel assembly 610A, an application cap 610B and a cup 610C. it will be appreciated that the application device 610 is not limited to include a cup 610C.

Figure 6B:
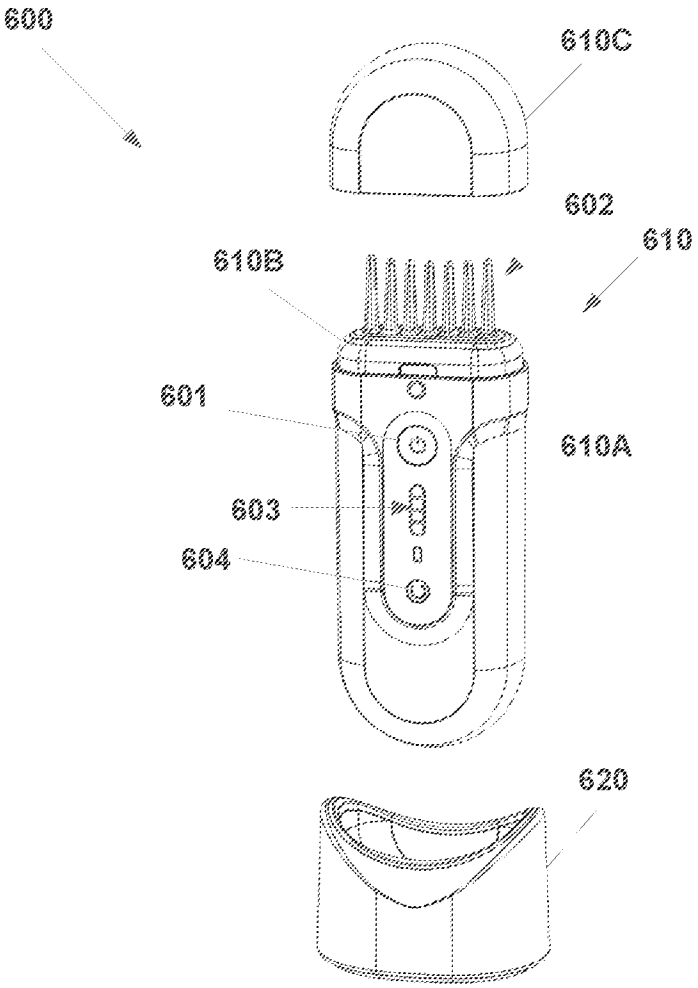
FIG. 6B shows an exploded view of FIG. 6A.

FIG. 6B shows an exploded view of FIG. 6A.

Figure 6C:
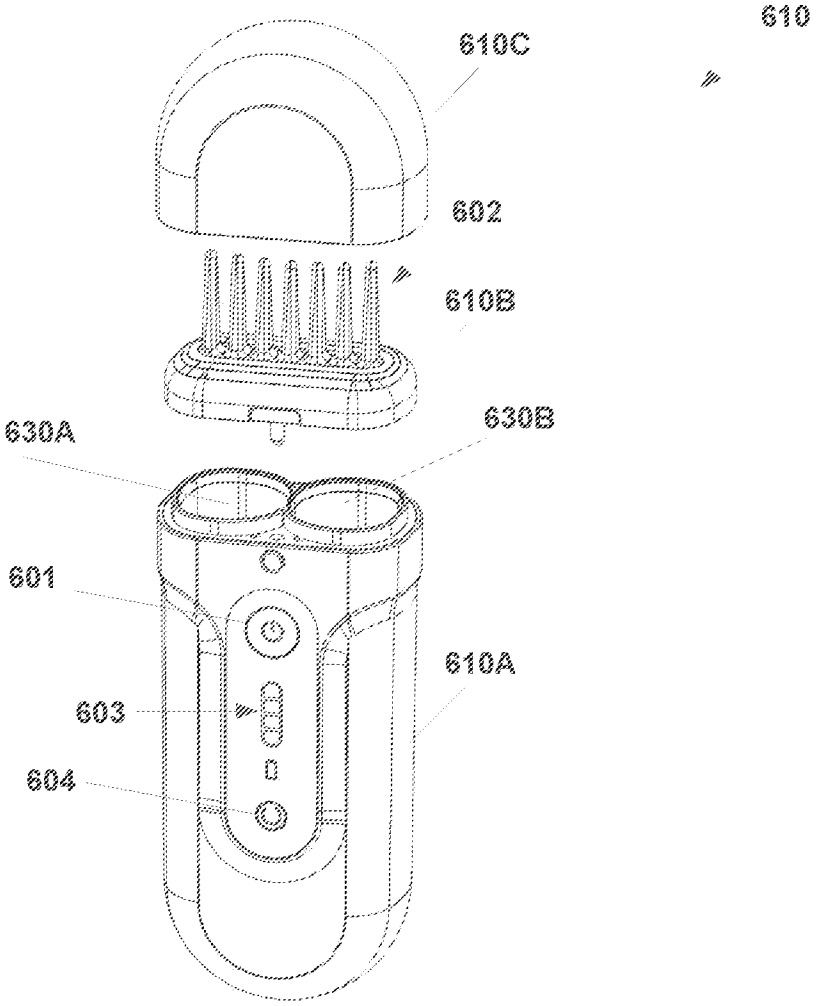
FIG. 6C shows an exploded view of application device 610.

FIG. 6C shows an exploded view of the application device 610, with two reversibly-couplable assemblies: a barrel assembly 610A and application cap 610B. Barrel assembly 610A includes two separate reservoirs 630A and 630B.

In many aspects and details, application device 610 is similar or identical to application devices 10, 106 and 120 discussed above. Some of the differences between device 610 and devices 10, 106 and 120 are discussed below. In many aspects and details, docking station 620 is similar or identical to docking station 122 discussed above. Some of the differences between docking station 620 and docking station 122 are discussed below.

Figure 6D:
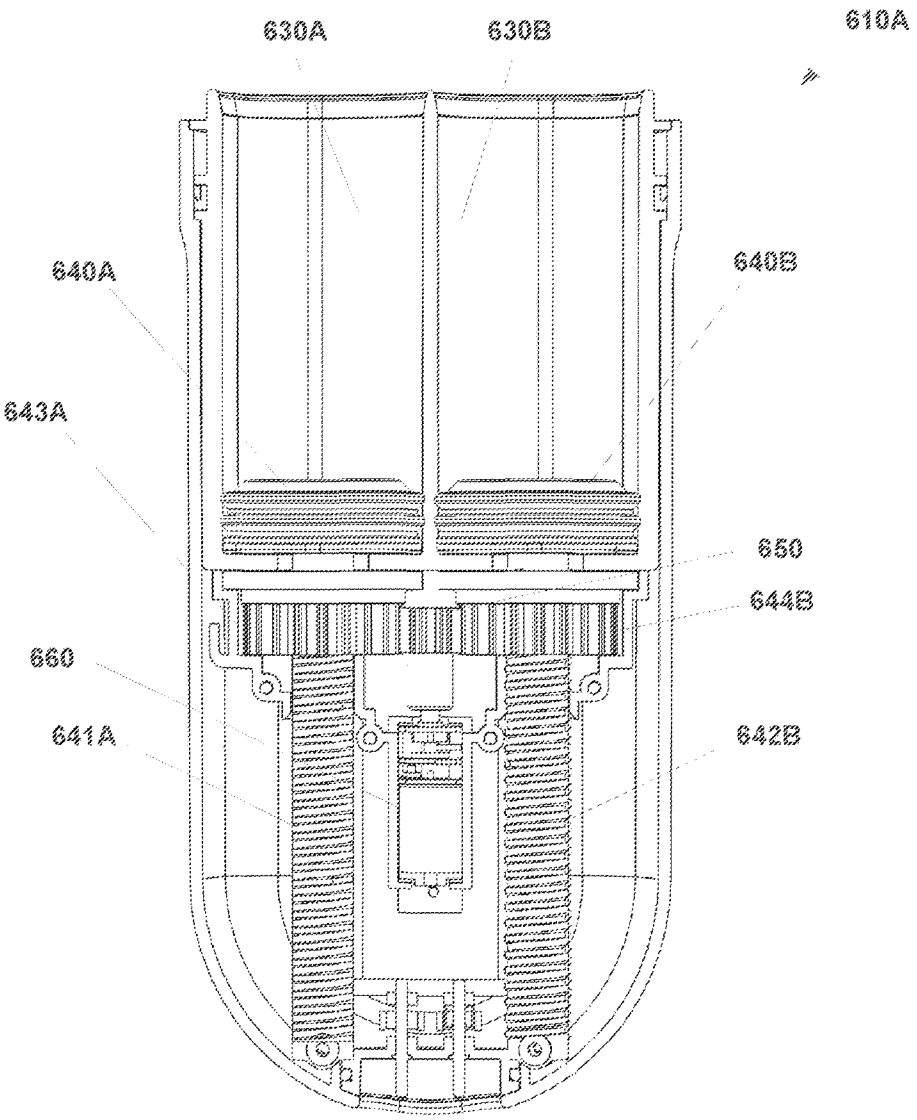
FIG. 6D shows a side cross section of barrel assembly 610A.

FIG. 6D shows a side cross section of barrel assembly 610A.

Figure 6E:
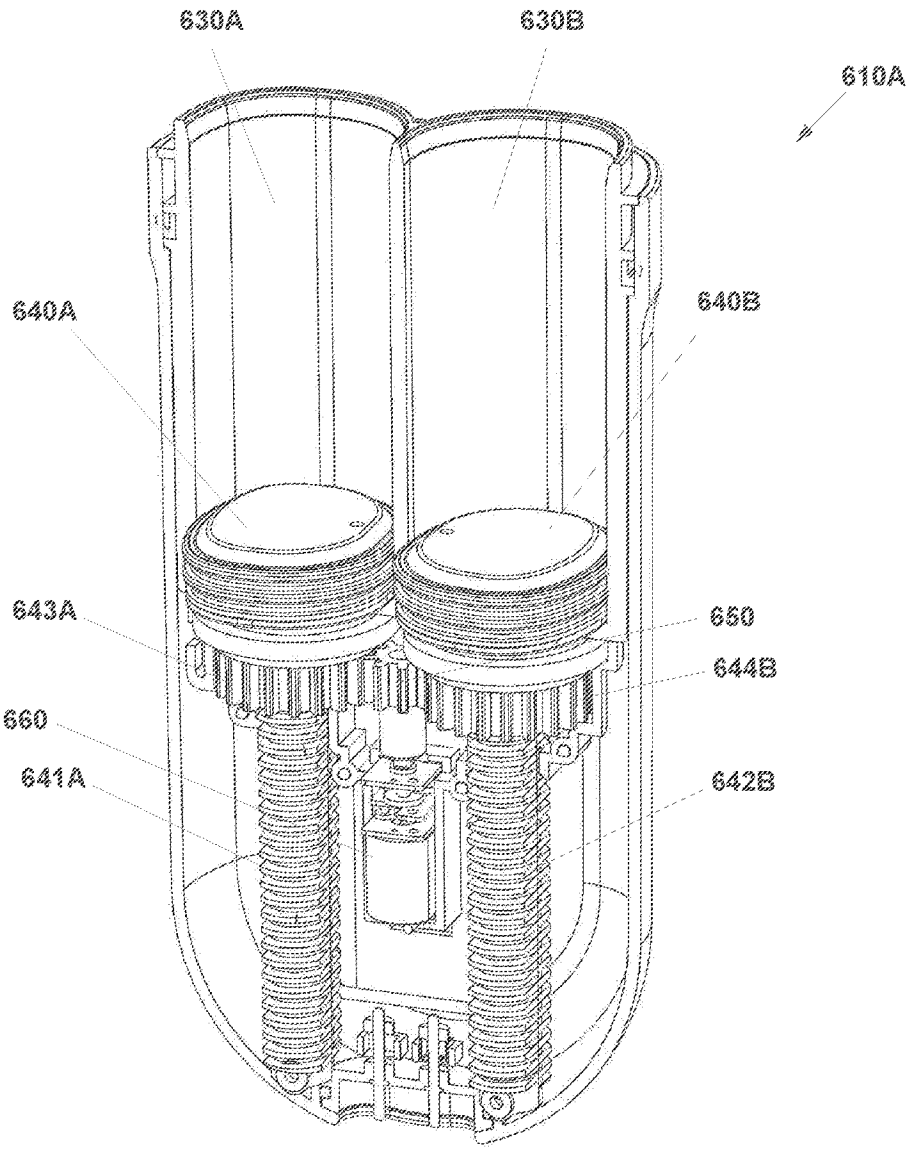
FIG. 6E shows a perspective cross section of barrel assembly 610A.

FIG. 6E shows a perspective cross section of barrel assembly 610A.

Barrel assembly 610A comprises two separate reservoirs 630A and 630B each comprising a piston 640A and 640B, respectively, intended to push the content held in reservoirs 630A and 630B towards application tines 602 of application cap 610B. According to the exemplary embodiment shown in FIGS. 6D and 6E, each piston 640A and 640B is mutually connected to a threaded shaft 641A and 642B, respectively, each passes through cogwheel 643A and 644B, respectively, such that the outer thread of each threaded shaft 641A and 642B mesh with the inner thread of its respective cogwheel 643A and 644B. The cogwheels 643A and 644B cannot move up and down and can only rotate, thus, when the cogwheels rotate in one direction the pistons move up and when the cogwheels rotate in the other direction the pistons move down. According to embodiments of the present invention, each threaded shaft 641A and 642B may be led by a leading channel or a pin allowing the pistons 640A and 640B to move up and down but not to rotate.

The Barrel assembly 610A further comprises a cogwheel 650 mounted between and in contact with cogwheels 643A and 644B such that teeth of cogwheel 650 mesh with teeth of cogwheels 643A and 644B; and a motor 660 intended to rotate cogwheel 650, which rotates cogwheels 643A and 644B, thereby moving the pistons 640A and 640B. The Barrel assembly 610A may further comprise components required for operation of device 610 including at least some of (not shown) an application controller which may include a speaker, a display, a user interface, a rechargeable power storage and a charger.

Back to FIG. 6A, according to embodiments of the present invention, the barrel assembly 610A may comprise a spring-loaded activation button 601 ordinarily biased in an outwards state but can be depressed to an inwards state by application of a force with the fingers or hands. When application cap 610B is attached to barrel assembly 610A and button 601 is in the inwards state, motor 660 drives cogwheel 650 which drives cogwheels 643A and 644B thereby moving pistons 640A and 640B distally to dispense the content held in reservoirs 630A and 630B through application tines 602 of an application cap 610B. When button 601 is released from the inwards state, it returns to the outwards state and motor 660 is momentarily reversed then stopped. As a result, pistons 640A and 640B are withdrawn a little in a proximal direction and an immediate suspension of dispensing of composition through tines 66 occurs (retraction). The activation of piston-driving motor 660 in accordance with the state of button 601 is by an application controller. It will be appreciated that other types of activation buttons may be used and the present invention is not limited to a spring-loaded activation button.

A LED array 603 made up of individually-activatable light-emitting diodes, e.g., 4, is used to indicate the amount of content held in the composition reservoirs: e.g., all LEDs lit indicating that reservoirs 630A and 630B are full, less LEDs lit indicating that reservoirs 630A and 630B are partially full, e.g., 75%, 50%, 25%, 12.5%—one LED blinks, 6%—one LED blinks faster and all LEDs blink few times may indicate that reservoirs 630A and 630B are empty. The activation of LED array 603 is by application controller. According to embodiments of the present invention, the barrel assembly 610A may further comprise a reset button 604 operating as discussed above.

Figure 6F:
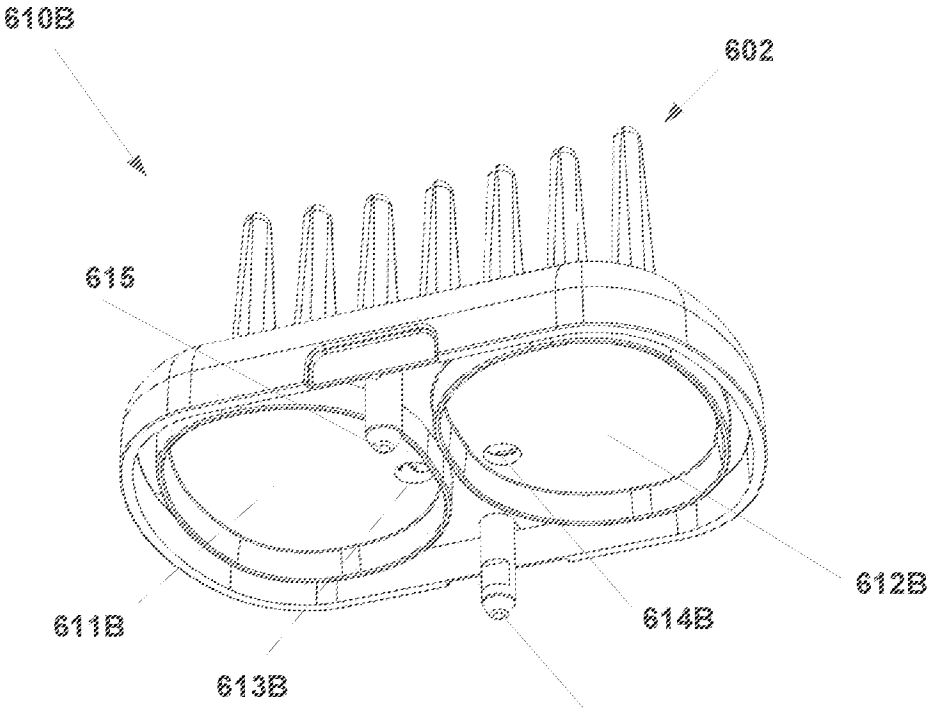
FIG. 6F shows a bottom perspective view of application cap 610B.

FIG. 6F shows a bottom perspective view of application cap 610B.

Figure 6G:
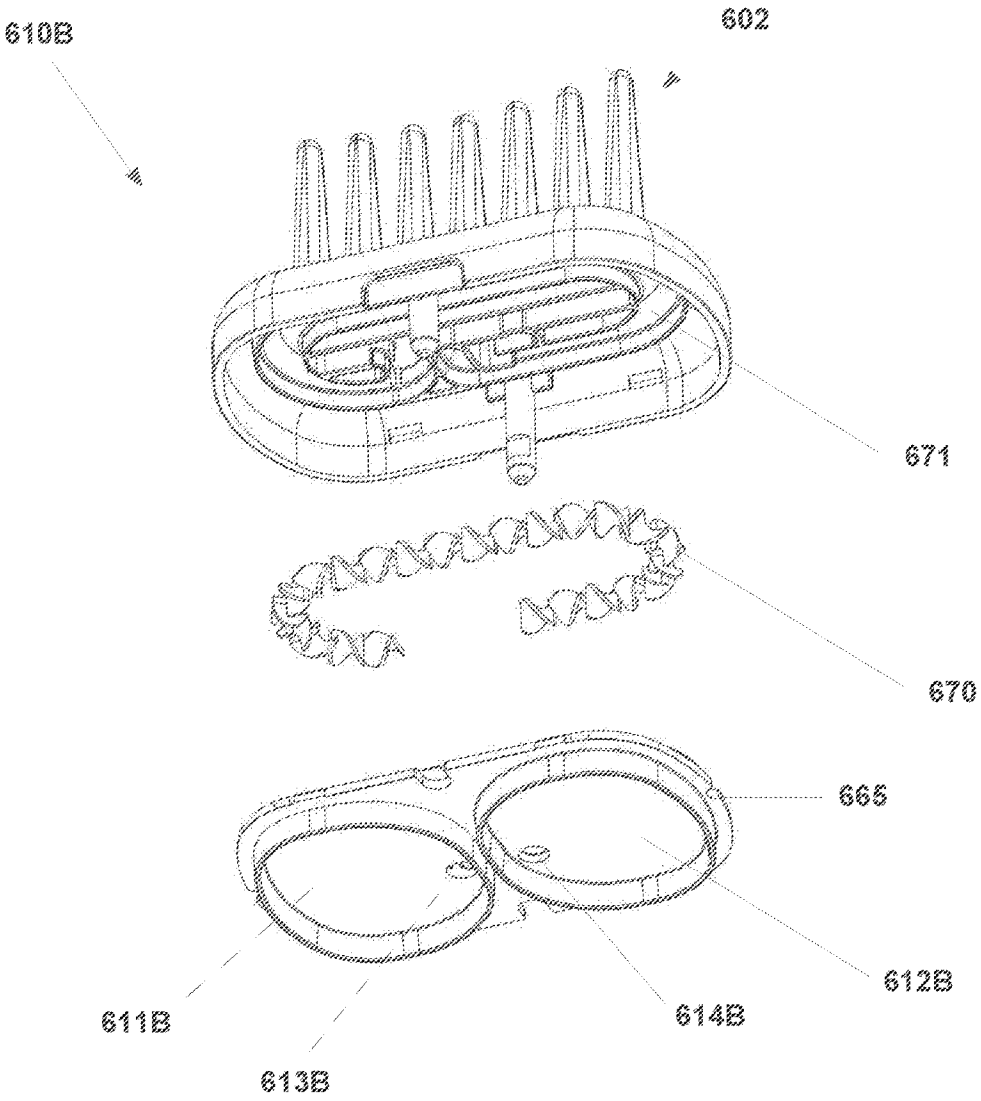
FIG. 6G shows an exploded view of FIG. 6F.

FIG. 6G shows an exploded view of FIG. 6F.

Figure 6H:
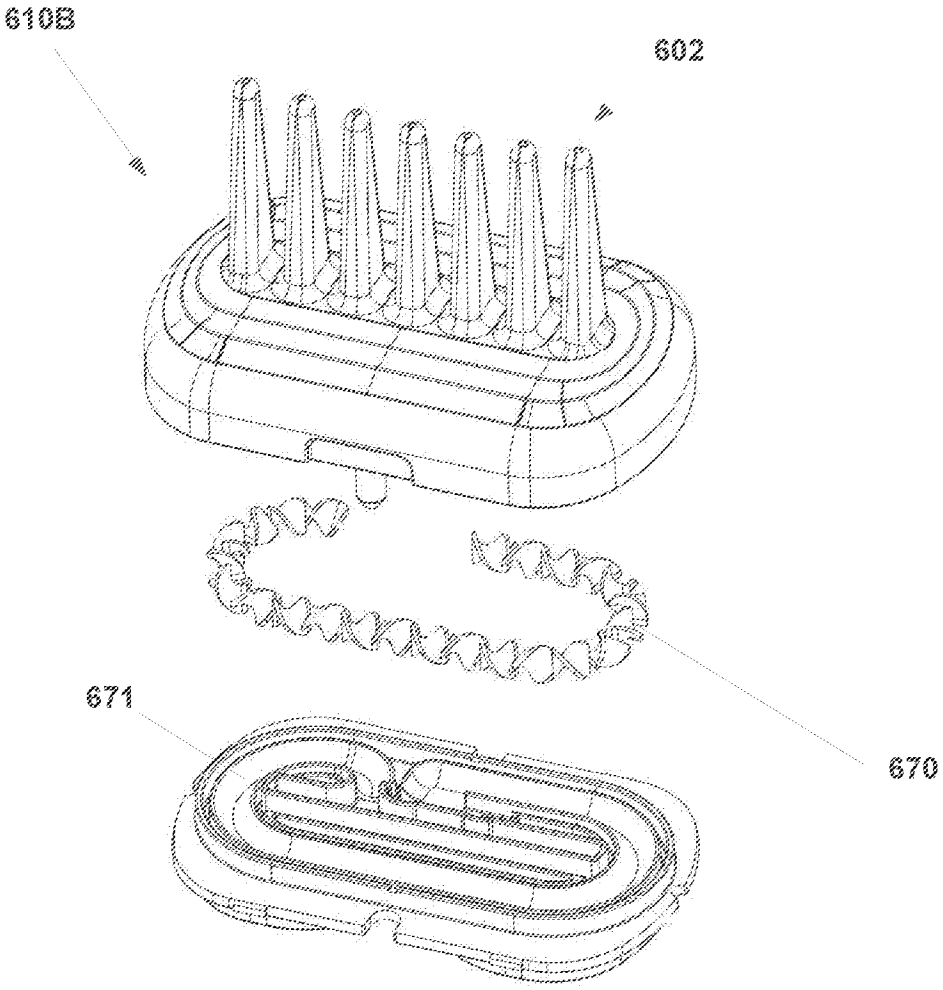
FIG. 6H shows a top perspective exploded view of application cap 610B.

FIG. 6H shows a top perspective exploded view of application cap 610B.

Figure 6I:
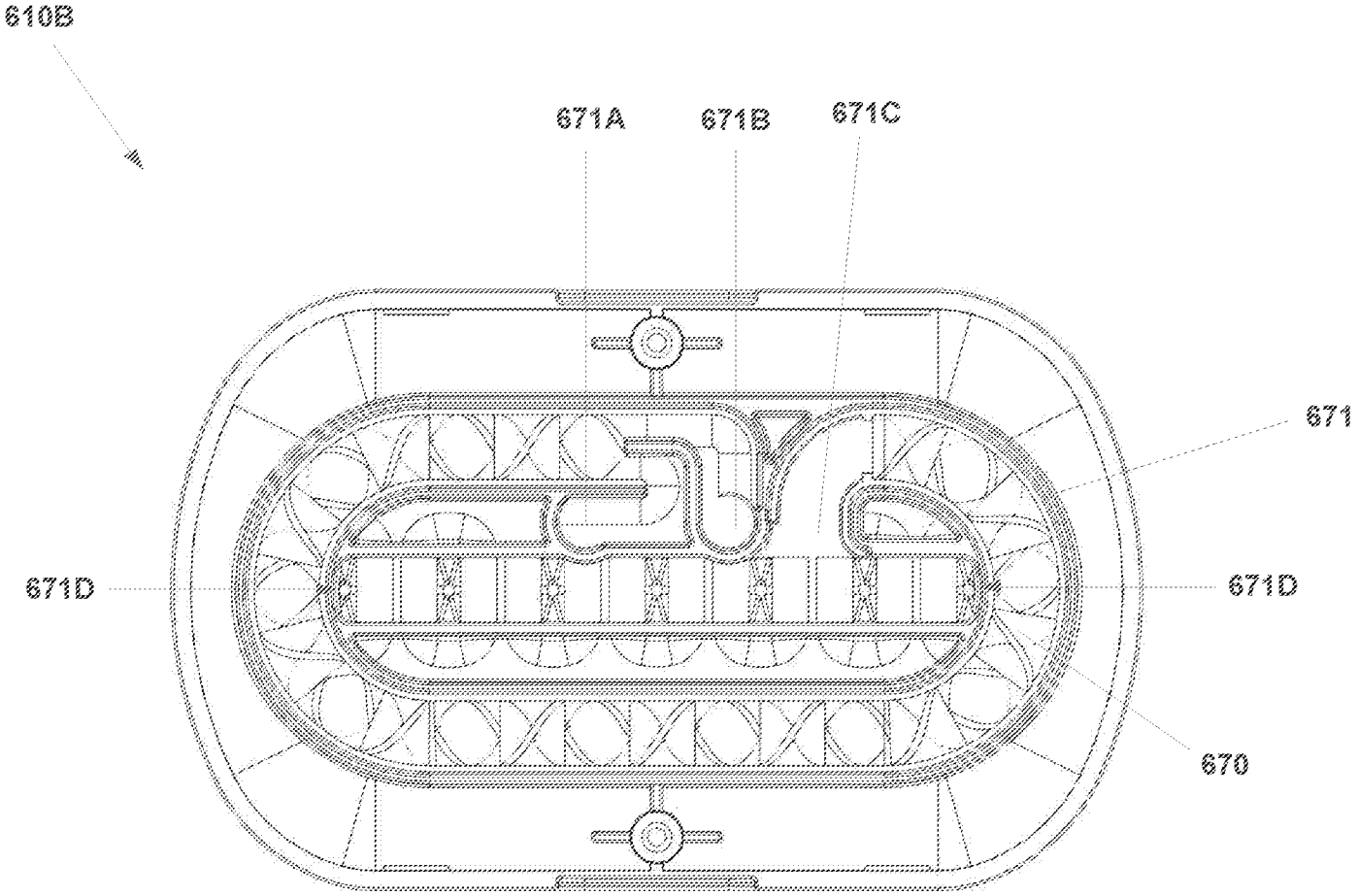
FIG. 6I shows a bottom view of application cap 610B.

FIG. 6I shows a bottom view of application cap 610B.

The application cap 610B comprises two caps 611B and 612B intended to seal reservoirs 630A and 630B, respectively, each having an orifice 613B and 614B, through which the content of each reservoir 630A and 630B may pass towards the tines 602. In the exemplary embodiment of FIG. 6F, the application cap 610B is intended to be reversibly connected with the barrel assembly 610A using pins 615. It will be appreciated that the present invention is not limited to connect application cap 610B with barrel assembly 610A using pins 615 and any suitable method, such as, twist, screw, clip, or any other suitable known in the art method may be used.

Referring to FIGS. 6G, 6H and 6I, application cap 610B further comprises a static mixer 670, mounted in a channel 671 mounted between part 665 and application tines 602. The channel 671 is sealed and in fluid communication on one end thereof with orifices 613B and 614B, and on the other end thereof in fluid communication with tines 602. When pistons 640A and 640B push the content of reservoirs 630A and 630B towards tines 602, the content of each reservoir passes through its respective orifice 613B and 614B and received at the entrance of channel 671, shown as 671A and 671B. When both contents progress through the static mixer 670, they are mixed to form a uniform composition at the other side (exit) of channel 671, shown as 671C, which is connected to the tines 602. The uniform composition fills an elongated space, 671D, mounted beneath the tines such that only when space 671D is full with the uniform composition, the composition is pushed through the tines 602 to uniformly exit through all the tines. It will be appreciated that space 671D is not limited to be elongated and does not necessarily have to be full. Alternatively, other methods of ensuring uniform exit of the composition through the tines may be used.

As mentioned above, according to embodiments of the present invention, each of the application devices discussed above may be intended to receive a cartridge or a capsule of hair-coloring composition. In such a case, each reservoir 630A and 630B may be intended to receive a capsule with a different part of a hair-coloring composition. Hence, instead of pouring the materials directly into the reservoir 630A and 630B, the user inserts two capsules, each with a different part of a hair-coloring composition and the device may operate as explained above or with minor modifications.

According to embodiments of the present invention, barrel assembly 610A may comprise, instead of two separate reservoirs 630A and 630B, a single reservoir intended to receive a capsule. In such an embodiment, the user may insert a designated capsule into that reservoir and the device may operate as explained above or with minor modifications. The designated capsule may comprise two separate reservoirs, each comprising a different part of a hair-coloring composition such that each reservoir is mounted above a piston. The designated capsule may further comprise an upper cover which may be removed by a user or torn by the force applied by the content of each reservoir when the pistons push the content towards the tines; and a bottom cover which may be removed by a user or torn by the force applied by the pistons.

Figures 7, 7A:
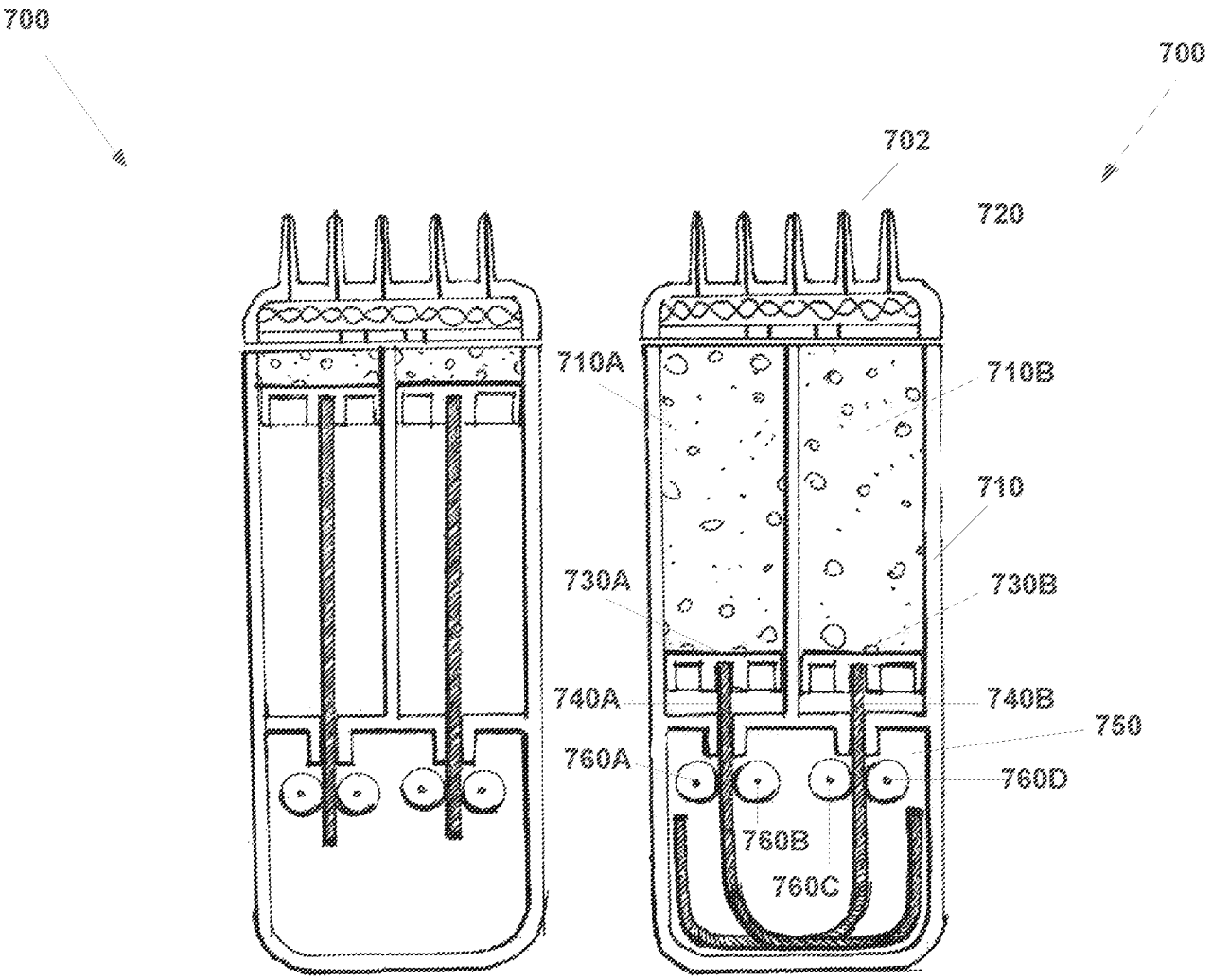
FIGS. 7 and 7A schematically depicts an embodiment of an application device according to the teachings herein in side view.

An additional embodiment of an application device according to the teachings herein, an application device is depicted in FIGS. 7 and 7A:

FIG. 7 shows a side cross section of another application device 700 comprising two reversibly-couplable assemblies: a barrel assembly 710 and an application cap 720.

Barrel assembly 710 includes two separate reservoirs 710A and 710B, each intended to receive a different part of a hair-coloring composition.

In many aspects and details, application device 700 is similar or identical to application devices 10, 106, 120 and 610 discussed above. Some of the differences between device 700 and devices 10, 106, 120 and 610 are discussed below. In many aspects and details, the docking station of application device 700 (not shown) is similar or identical to docking stations 122 and 620 discussed above. In many aspects and details, the application cap 720 is similar or identical to application cap 610B discussed above.

Barrel assembly 710 comprises two separate reservoirs 710A and 710B each comprising a piston 730A and 730B, respectively, intended to push the content held in reservoirs 710A and 710B towards application tines 702 of application cap 720. According to an exemplary embodiment, each piston is connected to a flexible lead cable 740A and 740B, each passes through the bottom of its respective reservoir into the lower cavity 750 of the barrel assembly 710 and through a driving mechanism (dispensing mechanism). The driving mechanism may be any driving mechanism capable of driving the flexible lead cables 740A and 740B thereby pushing the pistons towards the tines 702 in order to allow the hair-coloring composition contained in the reservoirs 710A and 710B to exit through the tines 702. In this exemplary embodiment, each driving mechanism comprises two transmission wheels, one 760A and 760B, and the other, 760C and 760D driven by a motor (not shown) such that in order to drive the pistons towards the tines, transmission wheels 760A and 760C rotates anticlockwise and transmission wheels 760B and 760D rotates clockwise.

The Barrel assembly 710 may further comprise components required for operation of device 700 including at least some of (not shown) an application controller which may include a speaker, a display, a user interface, a rechargeable power storage and a charger.

According to embodiments of the present invention, the barrel assembly 710 may comprise a spring-loaded activation button and a reset button (not shown) operating as discussed above.

Figures 8, 8A:
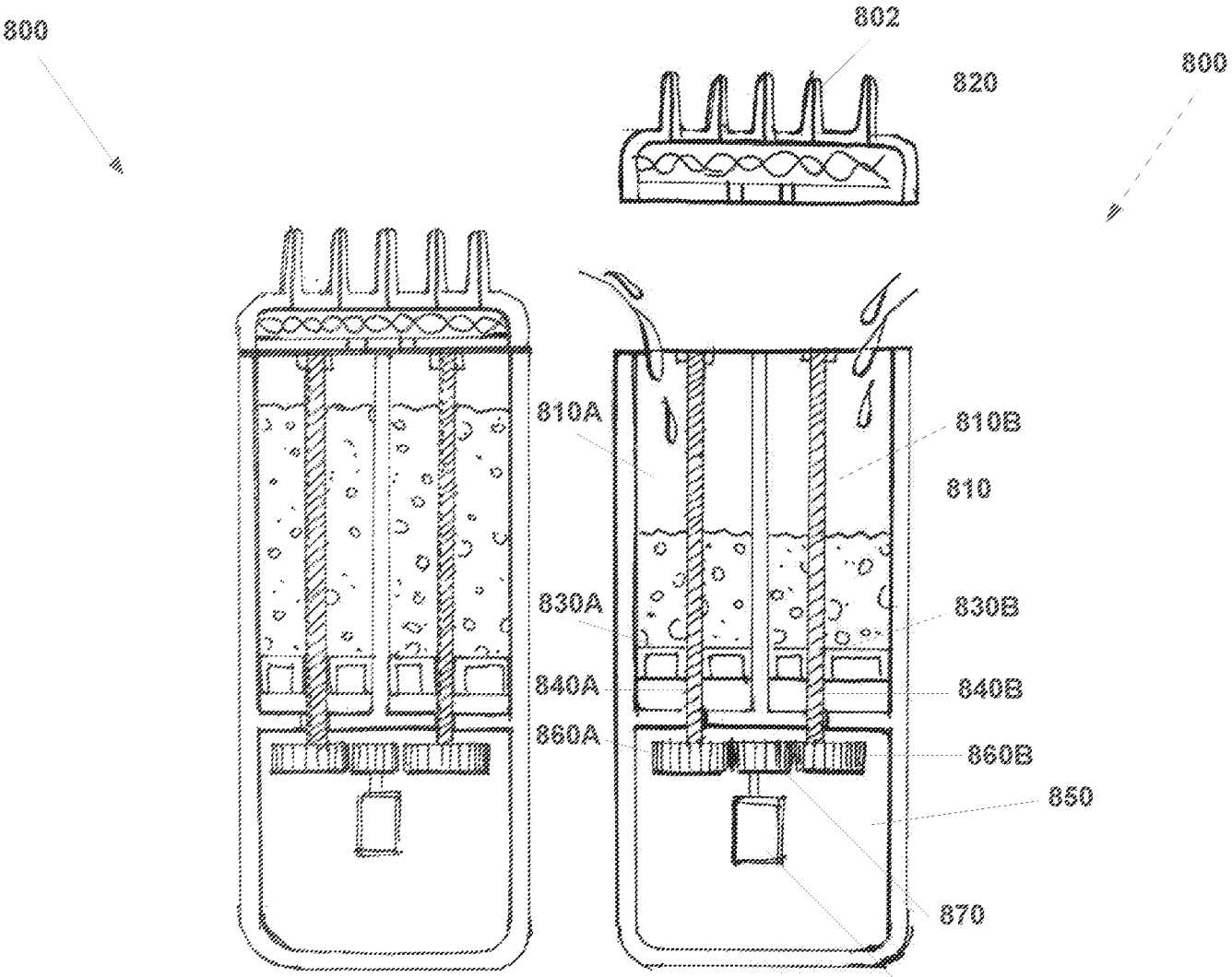
FIGS. 8 and 8A schematically depicts an embodiment of an application device according to the teachings herein in side view.

An additional embodiment of an application device according to the teachings herein, an application device is depicted in FIGS. 8 and 8A:

FIG. 8 shows a side cross section of another application device 800 comprising two reversibly-couplable assemblies: a barrel assembly 810 and an application cap 820.

Barrel assembly 810 includes two separate reservoirs 810A and 810B, each intended to receive a different part of a hair-coloring composition.

In many aspects and details, application device 800 is similar or identical to application devices 10, 106, 120, 610 and 700 discussed above. Some of the differences between device 800 and devices 10, 106, 120, 610 and 700 are discussed below. In many aspects and details, the docking station of application device 800 (not shown) is similar or identical to docking stations 122 and 620 discussed above. In many aspects and details, the application cap 820 is similar or identical to application cap 610B discussed above.

Barrel assembly 810 comprises two separate reservoirs 810A and 810B each comprising a piston 830A and 830B, respectively, intended to push the content held in reservoirs 810A and 810B towards application tines 802 of application cap 820. According to an exemplary embodiment, each piston is mounted around a rotatable threaded shaft 840A and 840B, respectively, such that the outer thread of each threaded shaft 840A and 840B mesh with the inner thread of its respective piston 830A and 830B. Each of the rotatable threaded shaft 840A and 840B passes through the bottom of its respective reservoir into the lower cavity 850 of the barrel assembly 810 and is mutually connected with a driving mechanism. In this exemplary embodiment, each rotatable threaded shaft 840A and 840B is mutually connected with cogwheel 860A and 860B, respectively, such that when the cogwheels move in one direction the pistons move up and when the cogwheels move in the other direction the pistons move down. According to embodiments of the present invention, each piston 830A and 830B may be led by a leading channel or a pin, mounted inside each piston's respective reservoir, thereby allowing the pistons 830A and 830B to move up and down but not to rotate.

The driving mechanism may be any driving mechanism capable of rotating cogwheels 860A and 860B thereby rotating shafts 840A and 840B and thereby moving the pistons towards the tines 802 in order to allow the hair-coloring composition contained in the reservoirs 810A and 810B to exit through the tines 802. In this exemplary embodiment, the driving mechanism comprises a cogwheel 870 mounted between and in contact with cogwheels 860A and 860B such that teeth of cogwheel 870 mesh with teeth of cogwheels 860A and 860B; and a motor 880 intended to rotate cogwheel 870, which rotates cogwheels 860A and 860B, thereby moving the pistons 830A and 830B.

The Barrel assembly 810 may further comprise components required for operation of device 800 including at least some of (not shown) an application controller which may include a speaker, a display, a user interface, a rechargeable power storage and a charger. According to embodiments of the present invention, the barrel assembly 810 may comprise a spring-loaded activation button and a reset button (not shown) operating as discussed above.

Figures 9, 9A:
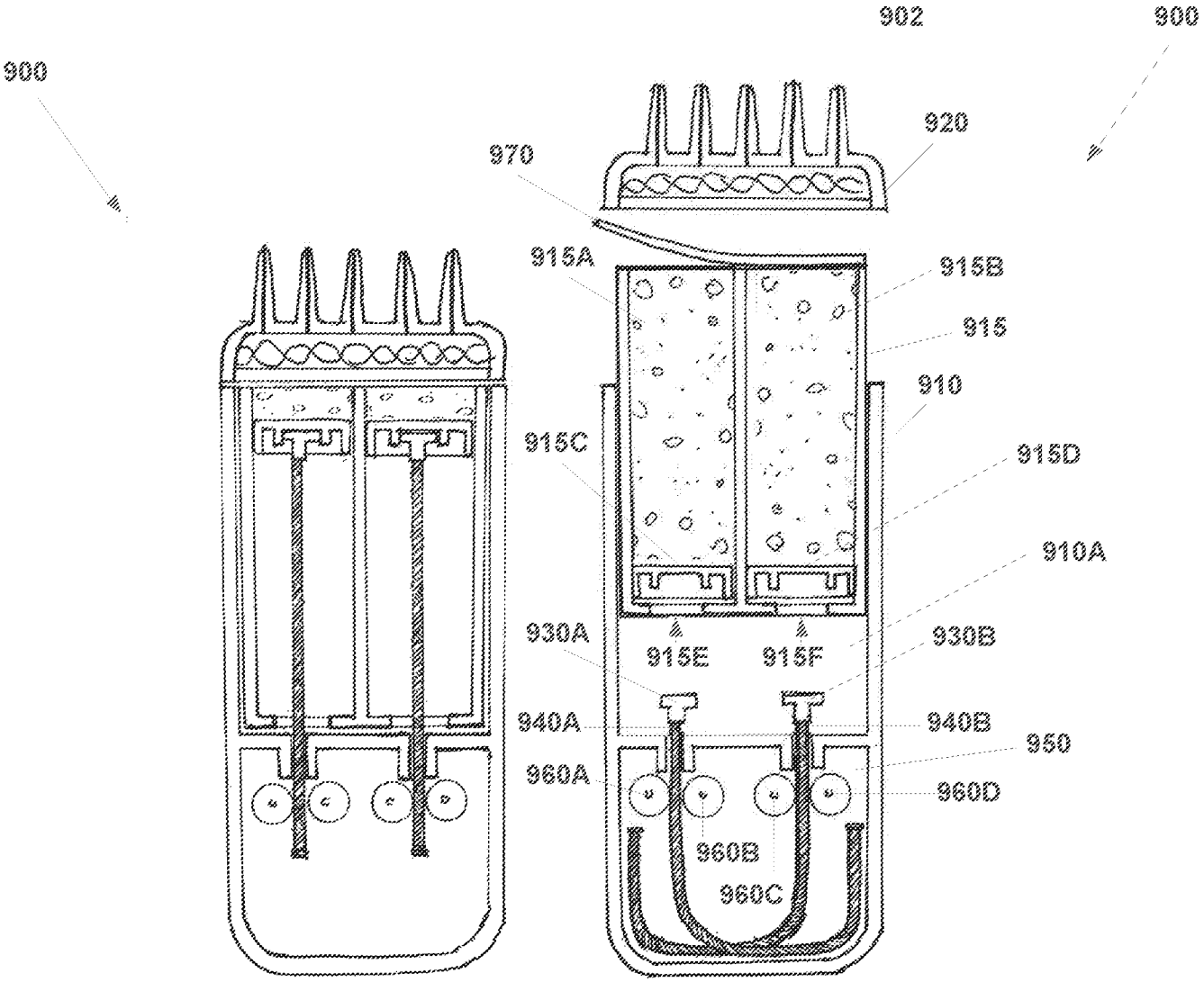
FIGS. 9 and 9A schematically depicts an embodiment of an application device and a capsule according to the teachings herein in side view.

An additional embodiment of an application device according to the teachings herein, an application device is depicted in FIGS. 9 and 9A:

FIG. 9 shows a side cross section of another application device 900 comprising two reversibly-couplable assemblies: a barrel assembly 910 and an application cap 920.

Barrel assembly 910 includes a reservoir 910A intended to receive a hair-coloring composition capsule or cartridge 915.

In many aspects and details, application device 900 is similar or identical to application devices 10, 106, 120, 610, 700 and 800 discussed above. Some of the differences between device 900 and devices 10, 106, 120, 610, 700 and 800 are discussed below. In many aspects and details, the docking station of application device 900 (not shown) is similar or identical to docking stations 122 and 620 discussed above. In many aspects and details, the application cap 920 is similar or identical to application cap 610B discussed above.

Barrel assembly 910 comprises a reservoir 910A comprising two elevating parts 930A and 930B intended to push pistons 915C and 915D, respectively, thereby pushing the content held in capsule 915 towards application tines 902 of application cap 920. According to an exemplary embodiment, each elevating part is connected to a flexible lead cable 940A and 940B, each passes through the bottom of the reservoir 910A into the lower cavity 950 of the barrel assembly 910 and into a driving mechanism. The driving mechanism may be any driving mechanism capable of driving the flexible lead cables 940A and 940B thereby moving the pistons 915C and 915D towards the tines 902 in order to allow the hair-coloring composition contained in the reservoirs 915A and 915B to exit through the tines 902. In this exemplary embodiment, each driving mechanism comprises two transmission wheels, one 960A and 960B, and the other, 960C and 960D driven by a motor (not shown) such that in order to drive the elevating parts towards the tines, transmission wheels 960A and 960C rotates anticlockwise and transmission wheels 960B and 960D rotates clockwise.

The Barrel assembly 910 may further comprise components required for operation of device 900 including at least some of (not shown) an application controller which may include a speaker, a display, a user interface, a rechargeable power storage and a charger.

According to embodiments of the present invention, the barrel assembly 910 may comprise a spring-loaded activation button and a reset button (not shown) operating as discussed above.

As mentioned above, the device 900 is intended to receive a capsule 915. The capsule 915 comprises two separate reservoirs 915A and 915B, each intended to contain a different part of a hair-coloring composition. Reservoirs 915A and 915B each comprises a piston, 915C and 915D, respectively, intended to move up inside its respective compartment. The bottom of capsule 915 comprises two openings 915E and 915F intended to allow the pistons 915C and 915D to be in contact with the elevating parts 930A and 930B, respectively, when the capsule 915 is inserted into the reservoir 910A. The capsule 915 is further intended to allow the hair-coloring composition contained in the reservoirs 915A and 915B to exit through the upper side of the capsule towards the tines 902. In the exemplary shown embodiment, the capsule 915 further comprises a cover 970, e.g., a foil, intended to be removed by a user prior to inserting the capsule 915 into the application device 900. It will be appreciated that the capsule 915 is not limited to be covered by a foil and the cover does not necessarily intended to be completely removed. Alternatively, the cover may be made from any material; the cover may be intended to be opened only in conjunction with the orifices 613B and 614B described above; the cover may be intended to be opened only in conjunction with the caps 611B and 612B described above; the cover may be made from a breakable material, etc.

Figures 10, 10A:
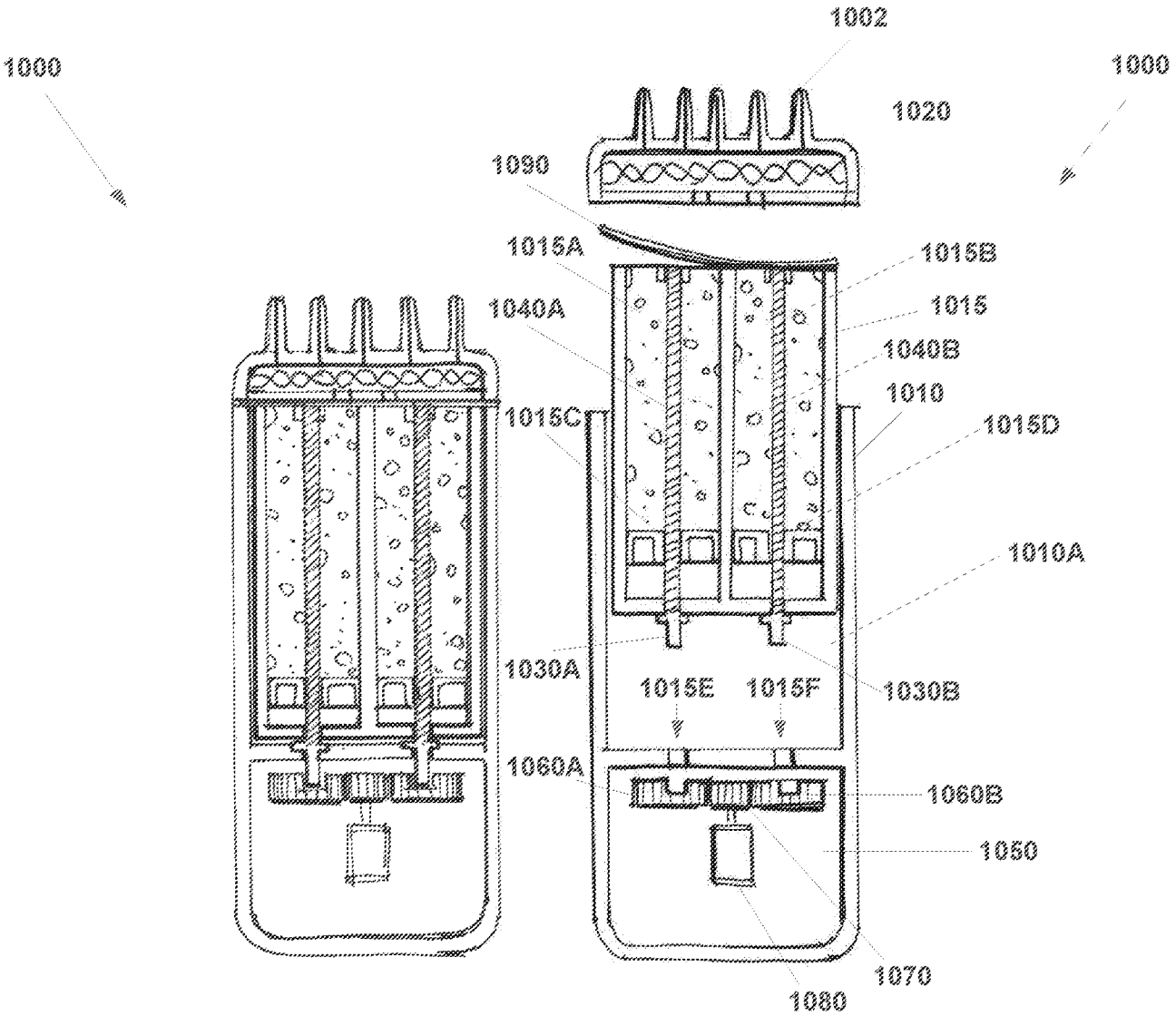
FIGS. 10 and 10A schematically depicts an embodiment of an application device and a capsule according to the teachings herein in side view.

An additional embodiment of an application device according to the teachings herein, an application device is depicted in FIGS. 10 and 10A:

FIG. 10 shows a side cross section of another application device 1000 comprising two reversibly-couplable assemblies: a barrel assembly 1010 and an application cap 1020.

Barrel assembly 1010 includes a reservoir 1010A intended to receive a hair-coloring composition capsule or cartridge 1015.

In many aspects and details, application device 1000 is similar or identical to application devices 10, 106, 120, 610, 700, 800 and 900 discussed above. Some of the differences between device 1000 and devices 10, 106, 120, 610, 700, 800 and 900 are discussed below. In many aspects and details, the docking station of application device 1000 (not shown) is similar or identical to docking stations 122 and 620 discussed above. In many aspects and details, the application cap 1020 is similar or identical to application cap 610B discussed above.

As mentioned above, the device 1000 is intended to receive a capsule 1015. The capsule 1015 comprises two separate reservoirs 1015A and 1015B, each intended to contain a different part of a hair-coloring composition. Each reservoir 1015A and 1015B comprises a piston, 1015C and 1015D, respectively, intended to move up inside its respective reservoir. According to an exemplary embodiment, each piston 1015C and 1015D is mounted around a rotatable threaded shaft 1040A and 1040B, respectively, such that the outer thread of each threaded shaft 1040A and 1040B mesh with the inner thread of its respective piston 1015C and 1015D. Each of the rotatable threaded shafts 1040A and 1040B passes through the bottom of its respective compartment and is mutually connected with gears 1030A and 1030B, respectively. The bottom of reservoir 1010A comprises two openings 1015E and 1015F intended to allow the gears 1030A and 1030B to be in contact with a driving mechanism mounted in the lower cavity 1050 of barrel assembly 1010 when the capsule 1015 is inserted into the reservoir 1010A. The driving mechanism may be any driving mechanism capable of rotating the gears 1030A and 1030B thereby rotating the shafts 1040A and 1040B and thereby moving the pistons towards the tines 1002 in order to allow the hair-coloring composition contained in the reservoirs 1015A and 1015B to exit through the upper side of the capsule towards the tines 1002. According to an exemplary embodiment, the driving mechanism comprises two recessed gears 1060A and 1060B mounted at the cavity 1050 beneath the openings 1015E and 1015F, a cogwheel 1070 mounted between and in contact with recessed gears 1060A and 1060B such that teeth of cogwheel 1070 mesh with outer teeth of recessed gears 1060A and 1060B; and a motor 1080 intended to rotate cogwheel 1070, which rotates gears 1060A and 1060B, thereby moving the pistons 1015C and 1015D. When the capsule 1015 is inserted into the reservoir 1010A, each gear 1030A and 1030B engages with its respective recessed gear 1060A and 1060B such that when the recessed gears 1060A and 1060B rotates, gears 1030A and 1030B rotate thereby moving the pistons 1015C and 1015D towards the tines 1002. In the exemplary shown embodiment, the capsule 1015 further comprises a cover 1090, e.g., a foil, intended to be removed by a user prior to inserting the capsule 1015 into the application device 1000. It will be appreciated that the capsule 1015 is not limited to be covered by a foil and the cover does not necessarily intended to be completely removed. Alternatively, the cover may be made from any material; the cover may be intended to be opened only in conjunction with the orifices 613B and 614B described above; the cover may be intended to be opened only in conjunction with the caps 611B and 612B described above; the cover may also be made from a breakable material, etc. According to embodiments of the present invention, each piston 1015C and 1015D may be led by a leading channel or a pin, mounted inside each piston's respective reservoir, thereby allowing the pistons 1015C and 1015D to move up and down but not to rotate.

The Barrel assembly 1010 may further comprise components required for operation of device 1000 including at least some of (not shown) an application controller which may include a speaker, a display, a user interface, a rechargeable power storage and a charger.

According to embodiments of the present invention, the barrel assembly 1010 may comprise a spring-loaded activation button and a reset button (not shown) operating as discussed above.

It will be appreciated that any of the above-described embodiments may require sealing solutions. For example, a seal between reservoirs and application cups, a seal between pistons and reservoirs, a seal between the upper part and the lower part of the barrel assemblies, a seal between parts passing from one cavity to another and generally any seal required to prevent leakage related to parts which come in contact with at least part of the hair-coloring composition. It will be appreciated that the present invention covers such sealing solutions. Exemplary sealing solutions may include, but are not limited to, O-rings, rubber, gaskets or any other sealing solution known in the art.

It will be also appreciated that that the barrel assemblies described above are preferably, water-resistant, that is to say, rinsing of the device (especially the reservoirs or compartments) with running water does not damage barrel assemblies or any of their components.

According to embodiments of the present invention, each of the capsules described above may comprise an application cap 610B connected thereto to form a single unit. In such a case the capsule along with the application cap are disposable and a user only has to insert a new capsule to the barrel assembly in order to operate the device.

According to embodiments of the present invention, any of the kits described above may further comprise a washing compartment intended to be connected to the application cap 610B such that in order to clean the application cap, a user fills the washing compartment with a cleaning fluid, e.g., water, connects the compartment to the cap and squeezes the compartment thereby streaming cleaning fluid through the tines and cleaning the cap including the static mixer and the tines.

According to embodiments of the present invention, the application cap 610B may be disposable such that any of the kits described above may comprise only a barrel assembly, a barrel assembly and a docking station or a barrel assembly, a docking station and at least one disposable application cap.

It will be appreciated that the present invention is not limited to the capsules' designs described above and any suitable capsule comprising two separate compartments, each containing a different part of a hair-coloring composition; and means for progressing the content held in each compartment out of the capsule, may be used.

It will also be appreciated that the present invention is not limited to the driving mechanisms described above and any driving mechanism which may enable driving pistons of a capsule may be used, e.g., a telescopic driving mechanism.

It will also be appreciated that any of the piston-related components, including the mechanism for driving the respective piston, described in conjunction with any of the above capsules may be implemented in barrel assembly 610A.

It will also be appreciated that any of the Barrel assemblies described above constitutes the device body.

Some of the application caps described above include a mixing mechanism, it will be appreciated that the present invention is not limited to a static mixer or to static mixing and any suitable mixing mechanism may be used.

Reversibly-connectable assemblies that constitute an application device according to the teachings herein may be configured to be reversibly-connectable in any suitable fashion. In the exemplary embodiments depicted above, barrel assembly 12 and mixing cap 14 or application cap 16 are reversibly-connectable using a twist-lock connector. Other suitable configurations include, for example, matching screw threads on the barrel assembly/cap.

An application device according to the teachings herein may have any suitable handle as described above. Application device 10 described above included a proximal portion 22 of barrel assembly 12 that constitutes a handle of device 10 being is a parallel-walled cylinder having a diameter of 6 cm. In some embodiments, such a handle has a different diameter, e.g., between 4 cm and 6 cm, or between 4.5 cm and 6 cm, or even between 4 cm and 5 cm or a different shape. As mentioned above, the barrel assembly 12 that constitutes a handle of device 10 is not limited to be cylindrical and may be of any shape.

An application device and/or a docking station according to the teachings herein may comprise any suitable user-interface to receive user commands and to provide information to a user. In the exemplary embodiments described above, the application devices include a speaker to provide a user with information aurally. Additionally or alternatively, some embodiments of a device include other information-providing components, for example, some embodiments comprise a vibrating component (e.g., including a piezo-electric vibratory part as known in the art of mobile telephony) to tactilely provide a user with information. In some of the embodiments described above with reference to the figures, any of the application devices described above may include a display/user interface 42 such as a touch screen as known in the art of digital input/output devices. In some embodiments, other display components and/or other input components (e.g., physical buttons, knobs and dials) may be used for implementing the teachings herein such as discussed, for example, with reference to device 120.

In the embodiments described above, moving any of the pistons all the way proximally was performed on receipt of a user command. In some preferred embodiments, for ease of use a device is configured that if no command is given for a predesignated time (e.g., 5 minutes, 10 minutes, 15 minutes), indicating the device is not in use, the piston is automatically moved all the way proximally. It will be appreciated that any of the pistons described above may be intended to move up during operation and down to a starting position when the process is completed, when the device is reset, before the device turned off, etc.

In some embodiments, during use or when imminent use is expected, a controller and other electronic components of an application device are configured to be ready for immediate use but, if no command is given for a predetermined time (e.g., 10 minutes, 20 minutes, 30 minutes, 60 minutes), indicating the device is unlikely to be used imminently, the controller and/or other components enter a low power-use "stand-by" state".

In the description above is described how the application devices are configured so that when actual application of composition is desired, a driving mechanism is continuously operated to continuously drive at least one piston in a distal direction. When it is desired to suspend administration, even temporarily, the application device is configured to automatically momentarily operate the driving mechanism in a reverse direction to withdraw the at least one piston in a proximal direction a small amount. As a result, there is an immediate suspension of dispensing of composition through the tines which would otherwise possibly leak or ooze from the distal tips of the tines.

In the embodiments described above with reference to the figures, application devices include rechargeable batteries as power storage 44 that are chargeable by inductive charger 46. In some embodiments, charging of such power storage is with a wired recharger (direct contact). In some embodiments, an application device includes non-rechargeable replaceable batteries, e.g., AA or AAA size batteries.

In some of the embodiments described above with reference to some of the figures, the reservoir axis and the tine axes are parallel with the body axis. In some embodiments the reservoir axis and the tine axes are within 30°, within 25°, within 20°, within 15°, within 10°, within 5° of parallel and even parallel with the body axis (as in the described embodiments).

As noted above, the application tines of the application device are preferably non-scratching, that is to say, that when pushed along the scalp should be configured not to cause any physical damage or irritation to the scalp. In preferred embodiments, the distal tips of the tines are rounded.

In the embodiments described above with reference to the figures, the application devices included eight hollow application tines for application of hair-coloring composition. In some embodiments, an application device according to the teachings herein has 3, 4, 5, 6, 7, 8, 9 or 10 tines, where through the shaft of each tine is a composition channel that provides fluid communication from at least one composition reservoir to the distal tip of the tine. Accordingly, in preferred embodiments an application device according to the teachings herein has 3, 4, 5, 6, 7 or 8 tines.

The cross-sectional size of the channels that pass through the tines is any suitable size and is typically dependent at least in part on the viscosity of the hair-coloring composition and/or components of the hair-coloring composition intended to be held in the composition reservoir. That said, considering the viscosity of known hair-coloring compositions, in some embodiments the cross-sectional size of the 2.5 channels that pass through the tines is equivalent to that of a circle having a diameter of between 1 mm and 2 mm.

In an embodiment described above with reference to the figures, it is noted that the separation between any two neighboring tines measured from the center of two neighboring tips is between 4 mm and 8 mm, more preferably not less than 5 mm and not more than 7 mm. The specific tine separation is not arbitrary but has been surprisingly found to provide superior results when the application device is advanced in accordance with the teachings herein, inter alia, because there is no excessive resistance to advancing the tines against the hair (which could happen if the tines are closer together) and sufficient coating with hair-coloring composition of the portion of the hair shafts that are close to the scalp (which coating may be insufficient if the tines are further apart).

As noted above, it is currently believed that achieving a "snow plow" effect is critical for effective distribution of hair-coloring composition. One factor for achieving such an effect is that the distal ends of the tines not be pointy and sharp, but rather have a rounded shape which has the added advantage of avoiding discomfort to the scalp of the user. In some preferred embodiments, the tines have rounded distal tips and have a diameter near the distal end of not less than 2 mm and not more than 4 mm. In preferred embodiments, the diameter is not more than 3.5 mm and even not more than 3 mm.

The length of the tines is any suitable length, preferably sufficiently long to pass underneath the hair, but not so long as to make use of the device uncomfortable. It has been found that for shorter hair the preferred tine length is 2.5 cm to 3.5 cm, and for long hair the preferred tine length is 3.5 cm to 8 cm, more preferably 3.5 cm to 6 cm.

As seen in FIGS. 1A, 1B, 4,5A, 6B and 7-10 the distal end of the application cap is not flat but is concave. It has been found that a concave distal end of an application cap is preferred to reduce the chance of contact of distal end with the scalp.

It will be appreciated that any of the driving mechanisms described above may also be called a dispensing mechanism.

It will be appreciated that the parts of the hair-coloring composition described above may be a coloring solution and a developer or any other parts included in a hair-coloring composition.

It will also be appreciated that as long as those two parts are separate, they may be saved for a long time. Only when the parts are mixed, there is a limited time to use them.

Therefore, according to embodiments of the present invention, any one of the devices described in conjunction with FIGS. 6-10 may comprise a cover or a cap.

Due to the fact that each of the devices keeps the two parts of the hair-coloring composition separately, a device cover may cover the reservoirs, instead of, or in addition to the application cap in order to enable further use.

In the embodiments described above with reference to the figures, a mixing cap and an application cap are reversibly connectable to a barrel assembly and the application device is configured to be at least partially reusable. In some embodiments, an application device is configured to be preferably disposable, provided with a composition reservoir precharged with components of a hair-coloring composition. For use, a user operates the device to combine and mix the separate components of the hair-coloring composition to form a hair-coloring composition in the reservoir, and then activates the device substantially as described above. In an embodiment described above, mixing motor 92 for mixing a hair-coloring composition found in reservoir 24 is a component of docking station 80. As a result, docking station 80 not only serves as a convenient holder to ease manipulation of application device 10, especially for charging reservoir 24 with components of a hair-coloring composition, but remains light in weight, in some embodiments, not more than 350 g weight when fully charged with hair-coloring composition. Alternatively, in some embodiments a mixing motor is a component of the barrel assembly as discussed with reference to FIGS. 5A, 5B and 5C. Alternatively, in some embodiments, the components of a hair-coloring composition are mixed during use as discussed with reference to FIGS. 6 to 10.

In some embodiments, a docking station such as docking station 80,122 or 620 includes scales which indicate (e.g., on a docking station display) the weight of an object held by the holder thereof. By accounting for the weight of a barrel assembly held thereby as tare weight, such a docking station can indicate the amount of material added to the reservoir, allowing a user (especially a hair-care professional) to add desired amounts of hair-coloring composition components (e.g., proportionally more or less developer to achieve a greater or lesser extent of lift).

In some embodiments, a device according to the teachings herein comprises a camera configured to capture video images of the area around the distal tips of the application tines and to transmit these images to a suitable image display device. Image transmission can be done using any suitable technology, e.g., Bluetooth®. The image display device may be any suitable display device, e.g., a smart phone, tablet computer, personal computer or any type of display screen.

As noted above, in some embodiments a device has a predetermined and/or user selected rate of dispensing hair-coloring composition held in a reservoir or a capsule. In some embodiments, a device includes a sensor to detect when application tines are in contact with a scalp (e.g., the sensor detects a force applied to the tips of the tines) and dispensing of hair-coloring composition from the reservoir occurs only when the sensor indicates that the tines are in contact with the scalp. In some embodiments, a device includes a sensor (e.g., an accelerometer as known in the art of smart phones) to determine the speed at which the tines are advanced along a scalp, and the rate of dispensing a hair-coloring composition from the reservoir is dependent also on the determined speed. In some embodiments, the distal tines may be a bit longer than the rest of the tines and the device may be intended to operate only when both of those longer tines are in contact with the scalp.

Unless otherwise defined, all technical and scientific terms used herein have the same meaning as commonly understood by one of ordinary skill in the art to which the invention pertains. In case of conflict, the specification, including definitions, will take precedence.

As used herein, the terms "piston" and "plunger" (as used in the priority documents) are synonymous and refer to a mechanical component as described herein that functions like the piston (plunger) of a syringe.

As used herein, the terms "comprising", "including", "having" and grammatical variants thereof are to be taken as specifying the stated features, integers, steps or components but do not preclude the addition of one or more additional features, integers, steps, components or groups thereof. These terms encompass the terms "consisting of" and "consisting essentially of".

As used herein, the indefinite articles "a" and "an" mean "at least one" or "one or more" unless the context clearly dictates otherwise.

As used herein, when a numerical value is preceded by the term "about", the term "about" is intended to indicate +/−10%.

As used herein, a phrase in the form "A and/or B" means a selection from the group consisting of (A), (B) or (A and B). As used herein, a phrase in the form "at least one of A, B and C" means a selection from the group consisting of (A), (B), (C), (A and B), (A and C), (B and C) or (A and B and C).

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the scope of the appended claims.

Citation or identification of any reference in this application shall not be construed as an admission that such reference is available as prior art to the invention.

Section headings are used herein to ease understanding of the specification and should not be construed as necessarily limiting.

It will be appreciated by persons skilled in the art that the present invention is not limited to what has been particularly shown and described hereinabove. Rather the scope of the present invention is defined by the appended claims and includes combinations and sub-combinations of the various features described hereinabove as well as variations and modifications thereof which would occur to persons skilled in the art upon reading the foregoing description.

The invention claimed is:

1. An application device for applying hair-coloring composition, comprising:

a device body, comprising:

a reservoir comprising a piston; said reservoir configured to receive a first part and a second part of a hair-coloring composition;

a stirring mechanism comprising a flexible, collapsible impeller; and an electric dispensing mechanism associated with said piston;

said dispensing mechanism configured to, upon activation, sealingly move said piston along with said collapsible impeller inside said reservoir; and an application cap comprising a plurality of projecting tines;

wherein said flexible, collapsible impeller is configured, in an uncollapsed state, to mix said first part and said second part of said hair-coloring composition to form a mixed hair-coloring composition;

wherein said application cap is configured for reversible-connection with said device body such that, when said application cap is connected with said device body, said reservoir is sealed from the outside except channels of said plurality of projecting tines which are in fluid communication with said reservoir; and wherein said dispensing mechanism is configured, when activated, to move said piston, along with said collapsible impeller, towards said plurality of projecting tines thereby pushing said mixed hair-coloring composition to be uniformly dispensed through said plurality of projecting tines, with said flexible, collapsible impeller being configured to move to a collapsed state upon contact with a surface of said application cap, further enabling the dispensing of the mixed hair-coloring composition.

2. The application device of claim 1, wherein said stirring mechanism further comprises:

a shaft connected with said impeller on one end thereof and on the other end thereof with a motor;

wherein said motor is configured to rotated said shaft thereby rotating said impeller and enabling mixing said first part and said second part of said hair-coloring composition to form a mixed hair-coloring composition.

3. The application device of claim 1, wherein said collapsible impeller, in said uncollapsed state, has an uncollapsed height dimensions, and in said collapsed state, has a collapsed height dimension smaller than said uncollapsed height dimension.

* * * * *